US007979019B2

(12) United States Patent
Yoshino

(10) Patent No.: US 7,979,019 B2
(45) Date of Patent: Jul. 12, 2011

(54) IMAGE FORMING APPARATUS, IMAGE FORMING METHOD, CONTROL PROGRAM, AND COMPUTER-READABLE PROGRAM

(75) Inventor: Hiroki Yoshino, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 1176 days.

(21) Appl. No.: 11/426,333

(22) Filed: Jun. 26, 2006

(65) Prior Publication Data

US 2007/0003340 A1 Jan. 4, 2007

(30) Foreign Application Priority Data

Jun. 29, 2005 (JP) ..... 2005-190604

(51) Int. Cl.
*G03G 21/00* (2006.01)

(52) U.S. Cl. ..... 399/366; 399/80; 399/391; 399/405; 283/902; 380/55

(58) Field of Classification Search ..... 399/366, 399/405, 80, 391; 283/902; 380/55
See application file for complete search history.

(56) References Cited

U.S. PATENT DOCUMENTS

| | | | | |
|---|---|---|---|---|
| 5,798,844 | A | 8/1998 | Sakano et al. | |
| 6,512,915 | B2 * | 1/2003 | Matsunoshita et al. | 399/366 |
| 2004/0035934 | A1 * | 2/2004 | Miyazawa et al. | 235/454 |
| 2005/0013640 | A1 * | 1/2005 | Kumakura et al. | 399/366 |

FOREIGN PATENT DOCUMENTS

| | | | |
|---|---|---|---|
| JP | 07-154617 | | 6/1995 |
| JP | 07-319347 | | 12/1995 |
| JP | 2000-196786 | | 7/2000 |
| JP | 2001-189855 | | 7/2001 |
| JP | 2002-209039 | | 7/2002 |
| JP | 2003-205661 | | 7/2003 |
| JP | 2004-164551 | | 6/2004 |
| JP | 2004-276515 | | 10/2004 |
| JP | 2004276515 | A * | 10/2004 |
| JP | 2005-72821 | | 3/2005 |
| JP | 2005-148240 | | 6/2005 |

* cited by examiner

*Primary Examiner* — Daniel J Colilla
*Assistant Examiner* — Andy L Pham
(74) *Attorney, Agent, or Firm* — Renner, Otto, Boisselle & Sklar, LLP

(57) ABSTRACT

The present invention provides an image forming apparatus capable of restricting copying using, as a master copy, a copy of a produced work such as a book. An MFP is provided with a printing permission/prohibition judging section and an output paper sheet selection section. The printing permission/prohibition judging section judges whether or not restriction information for restricting image formation is contained in either (i) an information tag provided in a document, or (ii) image data acquired by an image scanning section. The output paper sheet selection section selects a regulatory-information-containing recording paper sheet (i.e., a recording paper sheet on which a copy restriction code/pattern has been formed in advance, or a recording paper sheet having a wireless tag in which regulatory information has been stored in advance) as a recording paper sheet to be subjected to the image formation, which regulatory-information-containing recording paper sheet contains the regulatory information for prohibiting or restricting an image forming process based on the recording paper sheet on which an image has been formed.

5 Claims, 19 Drawing Sheets

FIG. 4

| | | | |
|---|---|---|---|
| PRODUCED WORK INFORMATION | PUBLICATION INFORMATION | TITLE OF BOOK | :OOOOO |
| | | NAME OF AUTHOR | :△△△△△ |
| | | DATE OF PUBLICATION | :(MONTH)/(DAY)/2005 |
| | GENERATION COPY INFORMATION | COPYRIGHT PROTECTION | :PROTECTED |
| | | GENERATION INFORMATION | :COPYRIGHTED ORIGINAL |
| | | NUMBER OF REMAINING TIMES PRINTING IS PERMITTED | :OTIMES |
| | OWNER INFORMATION | OWNER | :OO×× |

FIG. 6 (a)

PRINTING IS PERMITTED

FIG. 6 (b)

PRINTING IS PERMITTED

PUBLICATION INFORMATION | COPY INFORMATION

FIG. 6 (c)

TITLE OF BOOK : OOOOO
NAME OF AUTHOR : ΔΔΔΔΔ
DATE OF ISSUE : (MONTH)/(DAY)/2005

RETURN | COPY INFORMATION

FIG. 6 (d)

COPYRIGHT PROTECTION : PROTECTED
GENERATION INFORMATION : COPYRIGHTED ORIGINAL
NUMBER OF REMAINING TIMES PRINTING IS PERMITTED : OTIMES

RETURN | PUBLICATION INFORMATION

FIG. 6 (e)

PRINTING IS PROHIBITED

FIG. 6 (f)

PRINTING IS PROHIBITED

PUBLICATION INFORMATION | COPY INFORMATION

FIG. 6 (g)

TITLE OF BOOK : OOOOO
NAME OF AUTHOR : ΔΔΔΔΔ
DATE OF ISSUE : (MONTH)/(DAY)/2005

RETURN | COPY INFORMATION

FIG. 6 (h)

COPYRIGHT PROTECTION : PROTECTED
GENERATION INFORMATION : FIRST GENERATION
NUMBER OF REMAINING TIMES PRINTING IS PERMITTED : 0 TIME

PRINTING OF THIS DOCUMENT IS PROHIBITED.
PLEASE COPY FROM THE ORIGINAL.

RETURN | PUBLICATION INFORMATION

IMAGE FORMING APPARATUS, IMAGE FORMING METHOD, CONTROL PROGRAM, AND COMPUTER-READABLE PROGRAM

This Nonprovisional application claims priority under 35 U.S.C. §119(a) on Patent Application No. 190604/2005 filed in Japan on Jun. 29, 2005, the entire contents of which are hereby incorporated by reference.

FIELD OF THE INVENTION

The present invention relates to an image forming apparatus for making a copy of a produced work such as a book.

BACKGROUND OF THE INVENTION

In recent years, a high-performance image forming apparatus has been commercially available, so that it has become easy to make a substantially exact copy of an original produced work such as a book or the like.

The book or the like is copyrighted, but the copyright is infringed in many cases, for example, as follows: the book or the like is converted into image data and the image data is distributed without permission of the copyright holder. In order to prevent such illegal distribution of the image data, a technique has been proposed, for example, as follows.

Specifically, a system has been proposed which permits private use of image data but which prevents illegal copying of the image data. In this system, a permission condition for permitting use of image data desired by a user is designated in a server storing the image data, and the user receives the image data from the server in cases where the server permits, in accordance with the permission condition, the user to use the image data. Thus, only in cases where the data converted from a produced work is used for the private purposes, the proposed system permits copying of the data.

Meanwhile, a technique for preventing such a physical produced work as the book from being illegally copied by using a copying machine is described in each of Documents 1 and 2.

For example, Document 1 proposes a copying apparatus which is capable of supporting, in consideration of the copyright of the book, collection of a copying fee set for each copy source. Specifically, in Document 1, a document to be copied is scanned, by using a scanner, together with an extension added to the document. A copying condition correlated with the extension is acquired from a database. The copying, and the collection of the copying fee are carried out in accordance with the copying condition.

Further, Document 2 proposes a storage medium reading apparatus which does not make a comparison between (i) visible information and (ii) information stored in an electronic circuit chip, but which allows prevention of the illegal copying. Specifically, in Document 2, information indicating whether or not a book is permitted to be scanned is stored in a storage medium provided in the book, and the scanning of the book is controlled in accordance with the information.

However, the foregoing conventional arrangements have such a problem that: once a copy of a produced work is made, copying from the copy (such copying being hereinafter referred to as "generation copying") becomes possible, with the result that a copy of the produced work can be made.

Specifically, in Document 1, an identifier of the copy source is associated with a condition for making a copy of the copy source, and printing for making the copy is permitted in cases where the condition is satisfied. Furthermore, the identifier of the copy source is also associated with a fee-charging condition in the database. The fee-charging condition is acquired from the database. In accordance with the fee-charging condition, a fee-charging process is carried out. In this case, the collection of the copying fee set for each copy source can be supported in consideration of the copyright of the book. However, in cases where a copy of the produced work is used as a master copy, the copying can be carried out for an unlimited number of generations without the fee-charging process. Likewise in Document 2, once the produced work is copied into a recording medium which does not have a data storage medium such as an IC tag, the produced work can be copied from the copy of the produced work. This makes it impossible to prevent propagation of the generation copying.

In addition, Document 3 discloses an image forming apparatus which (i) adds a secret recognition mark to a copy of an image when carrying out copying in a confidential document copy mode, (ii) checks, when scanning a document, whether or not the document has the secret recognition mark, and (iii) prohibits the copying when the mark has been detected.

Further, Document 4 discloses an image forming apparatus which writes, in a recording paper sheet to be outputted, an IR- or UV-detectable specific pattern allowing for tracking-down and prohibition of copying.

Further, Document 5 discloses a copying apparatus which (i) detects, based on image data obtained by scanning an image from a document, whether or not a copy prohibition mark is provided in the document and (ii) prohibits copy output when the copy prohibition mark is detected.

Further, Document 6 discloses an image forming apparatus which uses at least two types of illegal copy prevention technique so as to embed, when outputting a hard copy of a created document, (i) information of the image forming apparatus or (ii) accessory information of the document into the hard copy of the document and which accordingly prevents illegal copying of the document.

(Document 1)
Japanese Unexamined Patent Publication No. 209039/2002 (Tokukai 2002-209039; published on Jul. 26, 2002)

(Document 2)
Japanese Unexamined Patent Publication No. 164551/2004 (Tokukai 2004-164551; published on Jun. 10, 2004)

(Document 3) Japanese Unexamined Patent Publication No. 154617/1995 (Tokukaihei 7-154617; published on Jun. 16, 1995): Corresponding to U.S. Pat. No. 5,798,844

(Document 4) Japanese Unexamined Patent Publication No. 319347/1995 (Tokukaihei 7-319347; published on Dec. 8, 1995)

(Document 5) Japanese Unexamined Patent Publication No. 189855/2001 (Tokukai 2001-189855; published on Jul. 10, 2001)

(Document 6) Japanese Unexamined Patent Publication No. 205661/2003 (Tokukai 2003-205661; published on Jul. 22, 2003)

SUMMARY OF THE INVENTION

The present invention has been made in view of the foregoing problems. It is an object of the present invention to provide an image forming apparatus capable of restricting copying to be made from a copy of an original produced work such as a book.

In order to solve the foregoing problems, an image forming apparatus according to the present invention is an image forming apparatus, including: image scanning means for scanning a document so as to acquire image data; image forming means for forming an image on a sheet in accordance with the image data; information judging means for judging whether or not restriction information for restricting image formation is contained in either (i) a storage device provided in the document, or (ii) the image data acquired by the image scanning means; and sheet selection means for, when the information judging section has judged that the restriction information is contained, selecting a regulatory-information-containing sheet as a sheet to which the image forming means carries out the image formation, which regulatory-information-containing sheet contains regulatory information for prohibiting or restricting image formation that is to be carried out in accordance with the image formed on the sheet.

Further, in order to solve the foregoing problems, an image forming method according to the present invention is an image forming method, including: an image scanning step of scanning a document so as to acquire image data; an image forming step of forming an image on a sheet in accordance with the image data; an information judging step of judging whether or not restriction information for restricting image formation is contained in either (i) a storage device provided in the document, or (ii) the image data acquired in the image scanning step; and a sheet selecting step of, when it has been judged in the information judging step that the restriction information is contained, selecting a regulatory-information-containing sheet as a sheet to which the image formation is carried out in the image forming step, which regulatory-information-containing sheet contains regulatory information for prohibiting or restricting image formation that is to be carried out in accordance with the image formed on the sheet.

According to the foregoing arrangement, in cases where the restriction information for restricting the image formation is contained in either (i) data stored in the storage device provided in the document or (ii) the image data, the regulatory-information-containing sheet containing the regulatory information is selected for the sake of prohibiting or restricting a later image forming process (an image scanning process and a developing process) to be carried out with the use of the sheet on which the image has been formed by the image forming means. With this, the sheet to which the image forming means carried out the image formation contains the regulatory information. Therefore, in cases where one attempts to carry out the copying process (image forming process) in accordance with the regulatory-information-containing sheet, the copying process is prohibited or restricted due to the regulatory information.

Therefore, the sheet outputted after the image formation contains the regulatory information, so that it is possible to prohibit or restrict the image forming process to be carried out in accordance with the sheet.

With this, for example, it is possible to prohibit or restrict copying (generation copying) to be made from a copy of a produced work (a regulatory-information-containing sheet on which an image has been formed).

The storage device is a medium capable of storing information, and examples of the medium include at least one of an IC tag, a flash memory, a hard disk, and the like.

In order to solve the foregoing problems, another image forming apparatus according to the present invention is an image forming apparatus, including: image scanning means for scanning a document so as to acquire image data; image forming means for forming an image on a sheet in accordance with the image data; information judging means for judging whether or not restriction information for restricting image formation is contained in either (i) a storage device provided in the document, or (ii) the image data acquired by the image scanning means; and regulatory information adding means for, when the information judging section has judged that the restriction information is contained, adding regulatory information to the sheet, which regulatory information allows prohibition or restriction of image formation that is to be carried out in accordance with the image formed on the sheet.

Further, in order to solve the foregoing problems, another image forming method according to the present invention is an image forming method, including: an image scanning step of scanning a document so as to acquire image data; an image forming step of forming an image on a sheet in accordance with the image data; an information judging step of judging whether or not restriction information for restricting image formation is contained in either (i) a storage device provided in the document, or (ii) the image data acquired in the image scanning step; and a regulatory information adding step of, when it has been judged in the information judging step that the restriction information is contained, adding regulatory information to the sheet, which regulatory information allows prohibition or restriction of image formation that is to be carried out in accordance with the image formed on the sheet.

According to the foregoing arrangement, the regulatory information is added to the sheet. With this, a copy of the document contains the regulatory information and is outputted from the image forming apparatus. Therefore, it is possible to prevent copying from being carried out without any limitation by using the copy.

Further, even in cases where the regulatory information has not been added in advance, the regulatory information can be added later. Therefore, the regulatory information can be added to any type of sheet.

The regulatory information may be added to the sheet, for example, by forming the regulatory information as an image on the sheet. In cases where the storage device is provided in the document, the regulatory information may be stored in the storage device.

Note that the image forming apparatus may be realized with the use of a computer. In this case, (i) a control program realizing the image forming apparatus with the use of a computer by operating the computer as each of the means and (ii) a computer-readable storage medium storing the control program are also encompassed in the scope of the present invention.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 4 is a diagram showing a data structure of produced work information.

FIGS. 6(*a*) to 6(*h*) are diagrams showing examples of information displayed by a user interface section, respectively.

DESCRIPTION OF THE EMBODIMENTS

One embodiment of the present invention will be described below. That is, an image forming apparatus according to the present embodiment is arranged as follows. That is, the image forming apparatus judges whether or not restriction information for restricting image formation (copying) to be carried out based on a document is contained in either (i) a storage device, such as an IC tag, which is provided in the document, or (ii) image data obtained by scanning the document. In cases where the restriction information is contained, the image forming apparatus outputs a sheet to which regulatory information has been added, which regulatory information allows regulation of image formation that is to be carried out in accordance with the sheet on which an image has been formed.

Moreover, in order to output the sheet to which the regulatory information has been added, the image forming apparatus carries out at least one of the following processes (1) and (2): (1) the image forming apparatus selects a regulatory-information-containing sheet which contains the regulatory information for prohibiting or restricting an image forming process to be carried out based on the sheet on which the image has been formed; and (2) the image forming apparatus adds, to the sheet on which the image is to be formed, the regulatory information for prohibiting or restricting the image formation. Specifically, the image forming apparatus carries out any one of the following processes (A) to (E): (A) the image forming apparatus carries out image formation with respect to a sheet on which the regulatory information has been recorded in advance as an image; (B) the image forming apparatus carries out image formation with respect to a sheet having a storage device in which the regulatory information has been stored in advance; (C) the image forming apparatus records the regulatory information as an image when carrying out image formation based on image data; (D) the image forming apparatus forms, on a sheet having a storage device, an image based on image data, and stores the regulatory information in the storage device; and (E) the image forming apparatus carries out a combination of the processes (A) to (D). This will be described below.

(Explanation of Operation of the Entire Apparatus)

One embodiment of an image forming apparatus according to the present invention explains a case where a digital copying machine (hereinafter referred to as "MFP (multifunction printer)") is used.

Figure 1:
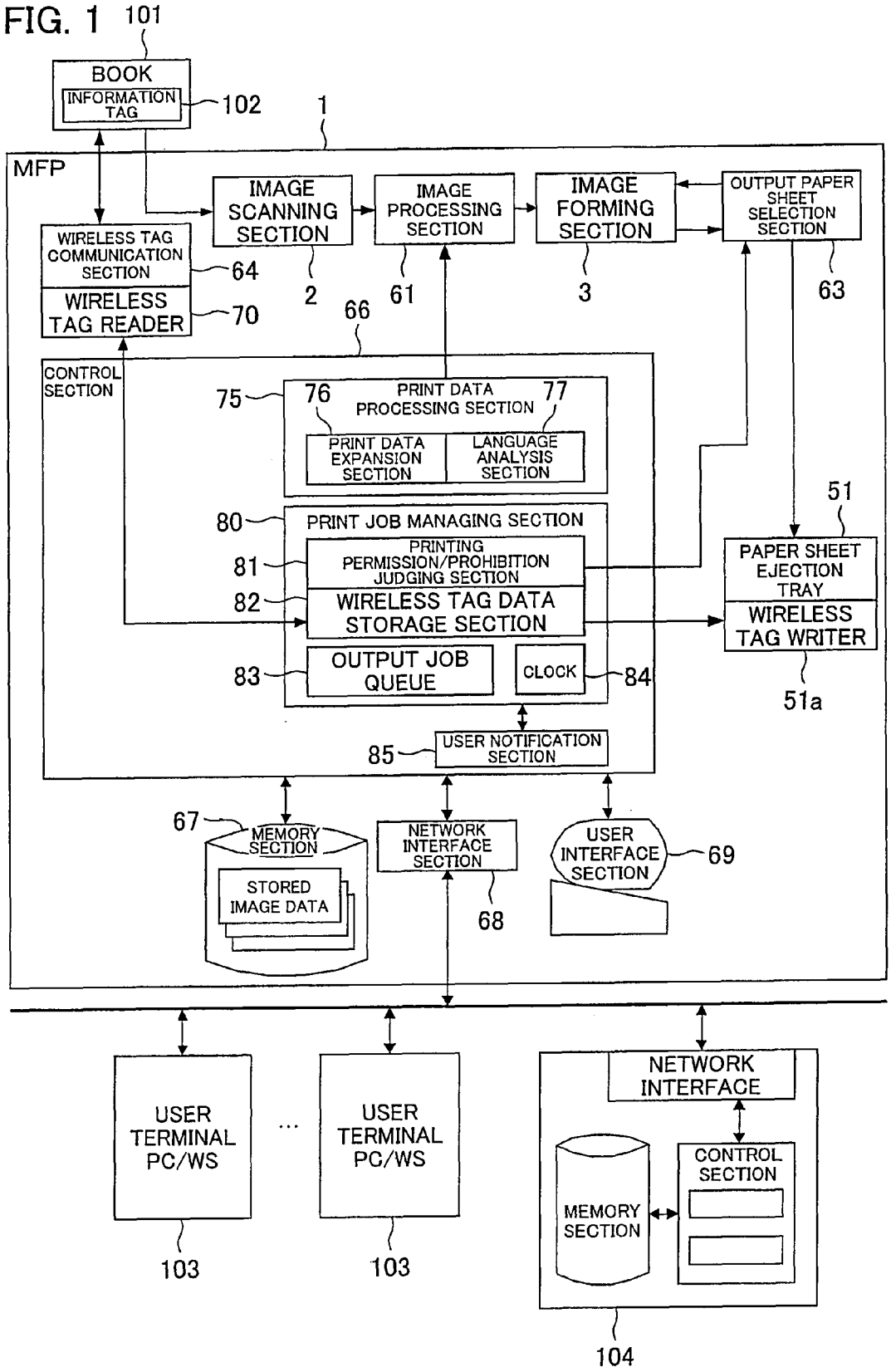
FIG. 1 is a block diagram schematically showing an arrangement of an image forming apparatus (MFP) according to the present embodiment.
Figure 2:
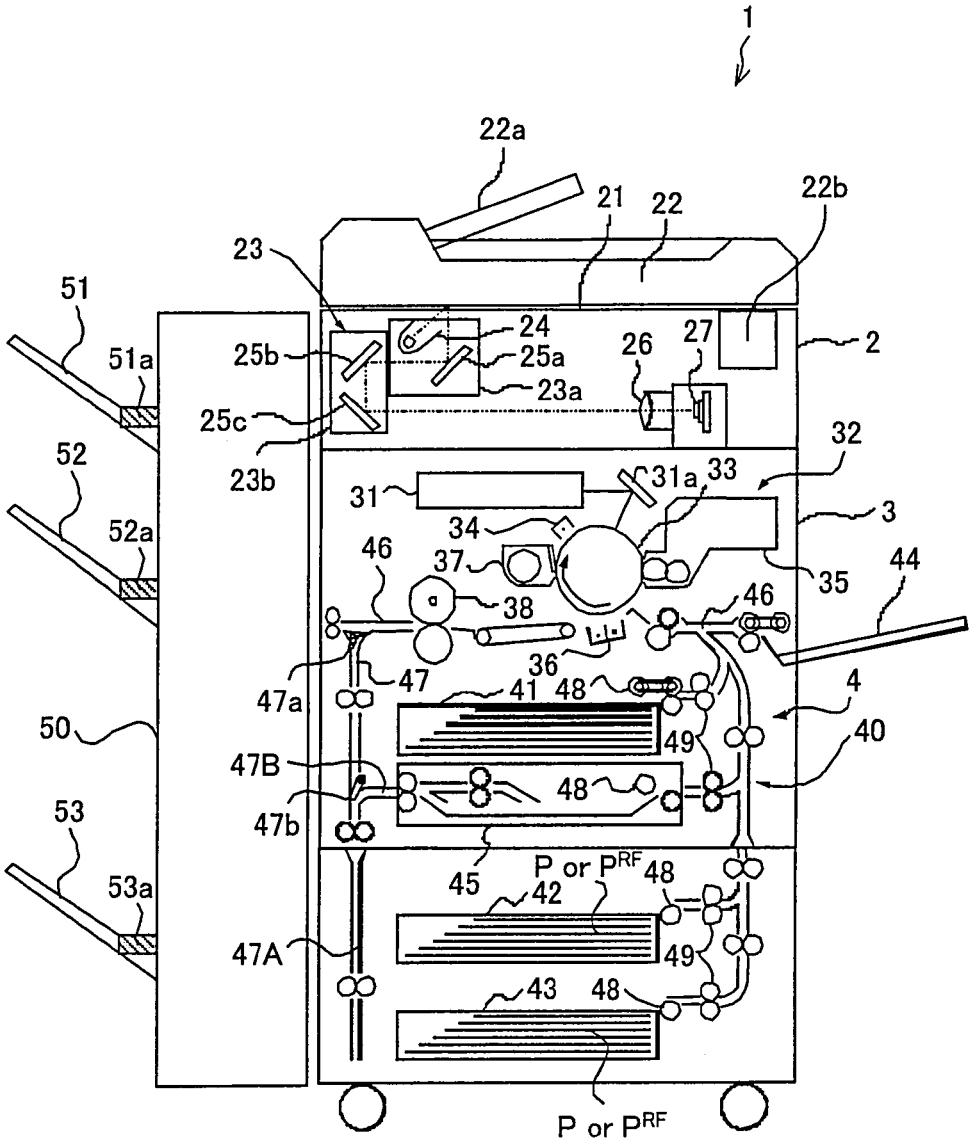
FIG. 2 is a cross-sectional view schematically showing an internal structure of the MFP.

FIG. 2 is a cross-sectional view schematically showing an internal structure of an MFP 1 according to the present embodiment. The MFP 1 is an apparatus which forms a multicolor or monochrome image on a predetermined recording paper sheet in accordance with image data sent from outside. As shown in FIG. 1, the MFP 1 includes: an image scanning section 2; an image forming section 3, which carries out image formation with respect to a wireless-tag-containing recording paper sheet PRF serving as a recording medium; and a paper sheet transporting mechanism 4, which transports the wireless-tag-containing recording paper sheet PRF to the image forming section 3. Each of the components will be described below.

<Image Scanning Section 2>

The image scanning section 2 includes: a document table 21, which is made of transparent glass or the like; a reversing automatic document feeder (hereinafter referred to as "RADF") 22 for feeding a document into the document table 21; and a scanner unit 23 for scanning the document transported into the document table 21. The image scanning section 2 generates image data by scanning the document placed on the document table 21. Further, in cases where the document placed on the document table 21 is a book in which a wireless tag is embedded, the image scanning section 2 reads out, by using a wireless tag reader installed in a wireless tag communication section 23*a*, produced work information stored in the wireless tag of the book. Then, the image scanning section 2 transmits the data to a control section provided in the MFP 1. The control section will be described later.

The RADF 22 includes an automatic paper sheet feeding tray 22*a* for automatically feeding, one by one into the document table 21, a plurality of documents set on the automatic paper sheet feeding tray 22*a*. Further, the RADF 22 is arranged such that the scanner unit 23 scans one side or both sides of the document in accordance with user's selection. Specifically, the RADF 22 includes: a transportation path for transporting, onto the document table 21, each of the documents set on the automatic paper sheet feeding tray 22*a*; and a reversing path for reversing the document so that the scanner unit 23 scans both sides of the document. In the case of scanning only one side of the document, only the transportation path is used. On the other hand, in the case of scanning both sides of the document, the document having passed through the transportation path is transported back to the document table 21. Therefore, each of the paths is provided with (i) transportation path switching means (not shown) and (ii) a group of sensors (not shown) for recognizing where in the path the document is being transported. The arrangement of the RADF 22 is publicly known, and therefore will not be explained.

The scanner unit 23 includes: a lamp reflector assembly 24; a plurality of reflecting mirrors 25*a*, 25*b*, and 25*c*; an optical lens body 26; and a charge-coupled device (CCD) 27.

The lamp reflector assembly 24 emits light to the document placed on the document table 21. The light is reflected from the document, and is caused by the reflecting mirrors 25*a*, 25*b*, and 25*c* to travel along a light path indicated by a chain double-dashed line in FIG. 2. Specifically, the reflecting mirror 25*a* reflects the light so that the light travels leftward in FIG. 2 so as to reach the reflecting mirror 25*b*. Then, the reflecting mirror 25*b* reflects the light so that the light travels downward so as to reach the reflecting mirror 25*c*. Thereafter, the reflecting mirror 25*c* reflects the light so that the light travels rightward in FIG. 2 so as to head for the optical lens body 26.

The operation of scanning the document is carried out as follows. That is, when the document is placed on the document table 21, a first scanning unit 23*a* made up of the lamp reflector assembly 24 and the reflecting mirror 25*a* scans horizontally the document table 21 so as to irradiate light all over the document. On this occasion, a second scanning unit 23*b* made up of the reflecting mirrors 25*b* and 25*c* moves, in the same direction as the first scanning unit 23*a* does and at a predetermined percent of speed at which the first scanning unit 23*a* moves (at half the speed at which the first scanning unit 23*a* moves). Then, the light, which has been reflected by the reflecting mirrors 25*a*, 25*b*, and 25*c* and which has passed through the optical lens body 26, forms an image on the charge-coupled device 27. Then, the charge-coupled device 27 converts the reflected light into an electrical signal (document image data).

The image data thus obtained is transmitted to an image processing section (not shown) so as to be subjected to various processes in the image processing section. Then, the image data is caused to be temporarily stored in a memory of the image processing section. Then, the image data thus stored in the memory is read out in response to an output instruction so as to be used for an image forming operation to be carried out by the image forming section 3.

<Image Forming Section 3>

The image forming section 3 includes a laser writing unit 31 and an electrophotographic processing section 32. The laser writing unit 31 irradiates, to a surface of a photosensitive drum 33 of the electrophotographic processing section 32, a laser beam in accordance with the document image data generated by the charge-couple device 27. Specifically, the laser writing unit 31 includes: a semiconductor laser source, which emits the laser beam corresponding to the image data; a polygonal mirror, which deflects the laser beam at a constant angular velocity; and an f-θ lens, which carries out correction such that the laser beam thus deflected scans the photosensitive drum 33 at a constant velocity.

The photosensitive drum 33 rotates in a direction indicated by an arrow in FIG. 2. The laser beam emitted from the laser writing unit 31 is reflected by a reflecting mirror 31*a*, and then the laser beam is received by the photosensitive drum 33, with the result that an electrostatic latent image is formed on the surface of the photosensitive drum 33.

Further, provided around the photosensitive drum 33 of the electrophotographic processing section 32 are: a charging device 34, a developing device 35, a transfer device 36, a peeling device, a cleaning device 37, an electricity-removing device, and a fixing device 38. The charging device 34 uniformly charges the surface of the photosensitive drum 33 before the electrostatic latent image is formed on the photosensitive drum 33. The developing device 35 uses toner as an image forming material so as to develop, into a visible image, the electrostatic latent image formed on the photosensitive drum 33 by the laser writing unit 31. The transfer device 36 transfers, onto a recording paper sheet P, the toner image formed on the surface of the photosensitive drum 33. The fixing device 38 heats the recording paper sheet P so as to fix, on the recording paper sheet P, the toner image transferred onto the recording paper P. The peeling device and the cleaning device 37 remove toner remaining on the surface of the photosensitive drum 33 after the toner image has been transferred. The electricity-removing device 38 removes a charge remaining on the surface of the photosensitive drum 33.

Thus, the image is formed on the recording paper sheet P as follows. That is, the charging device 34 charges the surface of the photosensitive drum 33 so that the surface of the photosensitive drum 33 has a predetermined potential. The laser writing unit 31 irradiates, to the surface of the photosensitive drum 33, the laser beam in accordance with the image data. Accordingly, the electrostatic latent image is formed on the surface of the photosensitive drum 33. Thereafter, the developing device 35 develops the visible image on the surface of the photosensitive drum 33 by using the toner, and the transfer device 36 transfers the toner image onto the recording paper sheet P fed from the paper sheet transporting mechanism 4. Thereafter, the recording paper sheet P is heated by the fixing device 38 such that the toner image is fixed on the recording paper sheet P. Meanwhile, the toner remaining on the surface of the photosensitive drum 33 is removed by the peeling device and the cleaning device 37, and the charge remaining on the surface of the photosensitive drum 33 is removed by the electricity-removing device 38. This is the end of a cycle of the image forming (printing) operation carried out with respect to the recording paper sheet P. By repeating the cycle, the image formation can be continuously carried out with respect to a plurality of recording paper sheets P, P, . . . .

<Paper Sheet Transporting Mechanism 4>

The paper sheet transporting mechanism 4 includes a first paper sheet cassette 41, a second paper sheet cassette 42, a third paper sheet cassette 43, and a multi manual feeding tray 44. The first to third paper sheet cassettes 41 to 43 contain recording paper sheets P or wireless-tag-containing recording paper sheets PRF of different sizes. In cases where the document placed on the document table 21 is a produced work in which a wireless tag is embedded, and where printing for making a copy of the document is permitted, the wireless-tag-containing recording paper sheets PRF are automatically selected in the paper sheet transporting mechanism 4. Further, in case of normal printing, recording paper sheets P of a size desired by the user are sequentially taken out one by one from a paper sheet cassette containing the recording paper sheets P, and then the recording paper sheets P thus taken out are sequentially transported to the image forming section 3 via a transportation path 40.

Further, the paper sheet transporting mechanism 4 transports, one by one to the image forming section 3, the recording paper sheets P or wireless-tag-containing recording paper sheets PRF contained in the first to third paper sheet cassettes 41 to 43 and the multi manual feeding tray 44. Each of the recording paper sheets P or wireless-tag-containing recording paper sheets PRF thus transported is subjected to image formation to be carried out by the image forming section 3. Then, the paper sheet transporting mechanism 4 ejects, to a first paper sheet ejection tray 51, a second paper sheet ejection tray 52, or a third paper sheet ejection tray 53, the recording paper sheet P or wireless-tag-containing recording paper sheet PRF subjected to the image formation. Further, the paper sheet transporting mechanism 4 includes a double-side copying unit 45. The double-side copying unit 45 collects the recording paper sheet P or wireless-tag-containing paper recording sheet PRF one side of which has been subjected to the image formation, and then supplies the recording paper sheet P or wireless-tag-containing paper recording sheet PRF to the image forming section 3 so that the image forming section 3 carries out image formation with respect to the other side of the recording paper sheet P or wireless-tag-containing paper recording sheet PRF.

The transportation path 40 of the paper sheet transporting mechanism 4 includes a main transportation path 46 and a reversing transportation path 47.

The main transportation path 46 has (i) an end (upstream end in the recording paper sheet transportation direction) branching to meet respective exit sides (ejection sides) of the first to third paper sheet cassettes 41 to 43 and the manual feeding tray 44; and (ii) the other end (downstream end in the recording paper sheet transportation direction) extending, via the transfer device 36 and the fixing device 38, to a post-processing apparatus 50 including the paper sheet ejection trays 51, 52, and 53.

The reversing transportation path 47 has an end (upper end in FIG. 2) which is connected to the main transportation path 46 in a downstream side (left in FIG. 2) with respect to a position where the fixing device 38 is provided, and has a midstream portion (central portion in the vertical direction in FIG. 2) which branches into a first branch path 47A and a second branch path 47B. The first branch path 47A extends vertically in the downward direction. On the other hand, the second branch path 47B has an end which meets an entrance side of the double-sided copying unit 45.

Provided in the part at which the reversing transportation path 47 is connected to the main transportation path 46 is a first branch pawl 47*a*. Provided in the branched portion of the reversing transportation path 47 is a second branch pawl 47*b*.

The first branch pawl 47*a* freely rotates with respect to a horizontal axis so as to be positioned in either a first position or a second position. When positioned in the first position, the first branch pawl 47*a* closes the reversing transportation path 47. When positioned in the second position, the first branch pawl 47*a* closes an exit side of the main transportation path 46 and connects the main transportation path 46 to the reversing transportation path 47. Specifically, when the first branch pawl 47*a* is positioned in the first position, the recording paper sheet P or wireless-tag-containing recording paper sheet PRF having passed through the image forming section 3 is ejected directly onto the paper sheet ejection tray 51, 52, or 53. On the other hand, when the first branch pawl 47*a* is positioned in the second position, the recording paper sheet P having passed through the image forming section 3 is supplied to the reversing transportation path 47.

The second branch pawl 47*b* freely rotates with respect to a horizontal axis so as to be positioned in either a first position or a second position. When the second branch pawl 47*b* is positioned in the first position, the first branch path 47A of the reversing transportation path 47 is opened, and the second branch path 47B of the reversing transportation path 47 is closed. When the second branch pawl 47*b* is positioned in the second position, the second branch path 47B is opened, and the first branch path 47A is closed. Specifically, when the second branch pawl 47*b* is positioned in the first position, the recording paper sheet P or wireless-tag-containing recording paper sheet PRF transported via the reversing transportation path 47 is guided to the first branch path 47A and is transported to a lower end position of the first branch path 47A. When the second branch pawl 47*b* is caused to be positioned in the second position thereafter, the recording paper sheet P or wireless-tag-containing recording paper sheet PRF is transported to the second branch path 47B via the branched portion, and then is supplied to the double-side copying unit 45. That is, the recording paper sheet P or wireless-tag-containing recording paper sheet PRF is supplied to the double-side copying unit 45 via the first branch path 47A and the second branch path 47B. Accordingly, the recording paper sheet P or wireless-tag-containing recording paper sheet PRF is reversed, and is supplied to the image forming section 3. This makes it possible to carry out the image formation with respect to the other side of the recording paper sheet P or wireless-tag-containing recording paper sheet PRF.

In cases where the MFP 1 of the present embodiment carries out single-side copying, the first branch pawl 47*a* is positioned in the first position. With this, the image forming section 3 carries out image formation with respect to the recording paper sheet P or wireless-tag-containing recording paper sheet PRF which has been taken out from the first paper sheet cassette 41, the second paper sheet cassette 42, the third paper sheet cassette 43, or the manual feeding tray 44. Then, the recording paper sheet P or wireless-tag-containing recording paper sheet PRF is ejected directly onto the paper sheet ejection tray 51, 52, or 53.

On the other hand, in cases where double-side copying is carried out, the first branch pawl 47*a* is positioned in the second position and the second branch pawl 47*b* is positioned in the first position. With this, the recording paper sheet P or wireless-tag-containing recording paper sheet PRF which has been taken out from the first paper sheet cassette 41, the second paper sheet cassette 42, the third paper sheet cassette 43, or the manual feeding tray 44 and one side of which has been subjected to the image formation carried out by the image forming section 3 is guided to the first branch path 47A of the reversing transportation path 47. Then, the second branch pawl 47*b* is caused to be positioned in the second position, and the recording paper sheet P or wireless-tag-containing recording paper sheet PRF is reversely directed and is transported from the branched portion to the double-side copying unit 45 via the second branch path 47B. Then, for the purpose of carrying out the image formation with respect to the other side of the recording paper sheet P or wireless-tag-containing recording paper sheet PRF, the first branch pawl 47*a* is caused to positioned in the first position, and the recording paper sheet P or wireless-tag-containing recording paper sheet PRF is transported from the double-side copying unit 45 to the image forming section 3 so that the image forming section 3 carries out the image formation with respect to the other side of the recording paper sheet P or wireless-tag-containing recording paper sheet PRF. Then, the recording paper sheet P or wireless-tag-containing recording paper sheet PRF is ejected onto the paper sheet ejection tray 51, 52, or 53.

Provided respectively in the upstream ends (i.e., parts which meet the exit sides of the first to third paper sheet cassettes 41 to 43, the manual feeding tray 44, and the double-side copying unit 45, respectively) of the main transportation path 46 are pick-up rollers 48. Further, provided in the downstream side of each of the pick-up rollers 48 are a plurality of paper sheet feeding rollers 49 for feeding, to the main transportation path 46, a recording paper sheet P or wireless-tag-containing recording paper sheet PRF picked up by the pick-up roller 48. Specifically, the paper sheet feeding rollers 49 rotate such that recording paper sheets P or wireless-tag-containing recording paper sheets PRF contained in the first to third paper sheet cassettes 41 to 43, the manual feeding tray 44, and the double-side copying unit 45 are selectively fed one by one to the main transportation path 46.

Further, as described above, the MFP 1 of the present embodiment has a paper sheet ejection section which includes the first to third paper sheet ejection trays 51, 52, and 53. The first paper sheet ejection tray 51 is provided on top of the second paper sheet ejection tray 52. The third paper sheet ejection tray 53 is equipped with a finisher.

Provided in the post-processing apparatus 50 is a transportation path for connecting the downstream end of the main transportation path 46 to each of the paper sheet ejection trays 51 to 53. The transportation path can be switched such that the recording paper sheet P or wireless-tag-containing recording paper sheet PRF is ejected onto any one of the paper sheet ejection trays 51 to 53.

Further, on the paper sheet ejection trays 51 to 53, wireless tag writers (sensors) 51*a*, 52*a*, and 53*a* are installed, respectively. The wireless tag writers 51*a* to 53*a* are installed thereon so as to write produced work information and generation copy information in the recording paper sheet PRF which was ejected to one of the ejection trays and on which an image was formed by the image forming section 3 as a result of the printing operation of copying the document in which the wireless tag is embedded. The produced work information is stored in the wireless tag of the document, and the generation copy information indicates that the recording paper sheet PRF is a first-generation copy. This will be described later.

Example 1

(Explanation of Operation in the Apparatus: Outline of a Functional Block)

The following fully explains an arrangement of the MFP 1 described above. FIG. 1 is a functional block diagram schematically showing the arrangement of the MFP 1.

As shown in FIG. 1, the MFP 1 (multifunction printer) is connected to a user terminal 103 (such as a PC or a work station) via a LAN (local area network). Moreover, as shown in FIG. 1, the MFP 1 includes: a wireless tag communication section 64; the image scanning section 2; an image processing section 61; the image forming section 3; a control section 66; a memory section 67; an output paper sheet selection section 63; a user interface section (user I/F section) 69; a network interface section (network I/F section) 68; and the paper sheet ejection trays 51 to 53 which include the wireless tag writers 51*a* to 53*a* respectively. Note that: in cases where it is not particularly necessary to separately explain the paper sheet ejection trays 51 to 53, explanation will be made for only the paper sheet ejection tray 51.

The wireless tag communication section 64 carries out reading/writing of information with respect to a wireless tag (storage device; hereinafter referred to as "information tag 102" for convenience of explanation) provided in a document 101 placed on the document table 21 of the MFP 1. Moreover, the wireless tag communication section 64 includes a wireless tag reader 70 for reading out, from the information tag 102 embedded in a book (hereinafter referred to as "document 101"), produced work information (document information), i.e., information concerning the document 101. Then, the produced work information read out by the wireless tag reader 70 is sent to a printing permission/prohibition judging section 81 of a print job managing section 80 provided in the control section 66. Further, as the wireless tag reader 70, a sensor having a multiread function may be used so as to deal with a case where a plurality of information tags 102 are embedded in the document 101.

The image scanning section 2 scans the document 101 by using a scanner function or a copy function. The image processing section 61 receives and appropriately corrects document image data obtained through the scanning, before image formation is carried out by the image forming section 3 provided in a later stage. The image forming section 3 receives the document image data from the image processing section 61, and forms an image on a recording paper sheet in accordance with the document image data.

The control section 66 controls each of the components of the MFP 1. Moreover, the control section 66 includes a print data processing section 75, the print job managing section 80, and a user notification section 85.

The print data processing section 75 receives, via the network interface section 68, image data (print data) based on which an image is to be formed by the image scanning section 3. Then, the print data processing section 75 (i) carries out a language analysis of the print data, (ii) expanding the print data, and (iii) transmits data for use in image formation. Then, the print data processing section 75 transmits, to the image processing section 61, the data for use in the image formation. Moreover, the print data processing section 75 includes: a language analysis section 77 for carrying out the language analysis; and a print data expansion section 76 for expanding the print data.

Further, the print data processing section 75 carries out a process such as an OCR process with respect to the image data acquired by the image scanning section 2, so as to analyze whether or not the image data contains specific information (e.g., a copy restriction code/pattern).

The print job managing section 80 manages an output job based on which the image is to be formed by the image forming section 3.

Specifically, the print job managing section 80 acquires the produced work information read out by the wireless tag communication section 64, and judges, in accordance with the produced work information, whether printing for copying the document 101 having the produced work information is permitted or prohibited. Then, the print job managing section 80 controls, in accordance with the printing permission/prohibition judgment, each of the components (the image forming section 3, the output paper sheet selection section 63, and the paper sheet ejection tray 51) involved in the image formation.

Moreover, the print job managing section 80 includes the printing permission/prohibition judging section 81, an output job queue 83, and a clock 84.

The printing permission/prohibition judging section 81 judges whether or not the image formation should be carried out in accordance with (i) the image data acquired by the image scanning section 2 or (ii) the print data acquired via the network interface section 68. Specifically, the printing permission/prohibition judging section 81 judges, in accordance with the produced work information acquired by the wireless tag reader 70, whether the printing is permitted or prohibited.

Moreover, the printing permission/prohibition judging section 81 includes a wireless tag data storage section 82 for storing the produced work information which is stored in the information tag 102 and which has been acquired by the wireless tag reader 70 provided in the wireless tag communication section 64.

Further, in cases where the specific information is contained in the image data which has been obtained through the scanning carried out by the image scanning section 2 and which has been analyzed by the print data processing section 75, the printing permission/prohibition judging section 81 of the print job managing section 80 judges, in accordance with the specific information (e.g., a copy restriction code/pattern), whether the printing is permitted or prohibited. This will be described later.

The output job queue 83 manages the order of a plurality of image formation jobs. When each of the jobs is processed, the output job queue 83 associates, with time, the produced work information acquired from the information tag 102. The clock 84 measures time.

Then, the print job managing section 80 judges, in accordance with the produced work information sent from the wireless tag communication section 64, whether the printing is permitted or prohibited. In cases where the source material in the printing is a produced work, the print job managing section 80 sends an output paper sheet selection command to the output paper sheet selection section 63 so that a wireless-tag-containing recording paper sheet having a wireless tag (storage device) is forced to be fed, and sends a job output command to the output job queue 83. The output job queue 83 manages the order of a plurality of image formation jobs. When each of the jobs is processed, the output job queue 83 associates, with time, the produced work information acquired from the information tag 102.

When the print job managing section 80 judges that the image forming section 3 has finished the printing carried out by processing the output job, the following information is written in the wireless tag added to the printed material (wireless-tag-containing recording paper sheet) ejected onto the paper sheet ejection tray 51: (i) the produced work information and the time associated with each other by the output job queue 83 and (ii) generation copy information indicating that the printed material is a first-generation copy. In this way, the produced work information is inherited.

The user notification section 85 operates the user interface section 69 so as to notify, in accordance with a result of the judgment carried out by the printing permission/prohibition judging section 81, publication information to the user. The publication information includes at least one of (i) the printing permission/prohibition judgment result indicating whether the printing is permitted or prohibited, (ii) the produced work information, (iii) restriction information such as the number of remaining times the printing is permitted, (iv) the generation copy information, and (v) the like. Also, in accordance with the result of the judgment carried out by the printing permission/prohibition judging section 81, the user notification section 85 notifies the user of a matter that should be notified to the user. A specific example of the matters is a case where a fee-charging process described later is necessary.

The memory section 67 stores, for example, (i) the data (print data) sent from outside via the network interface section 68 and (ii) the image data acquired by the image scanning section 2.

The user interface section 69 is made up of a liquid crystal panel such as a touch panel, a button for use in operation, and the like. The user interface section 69 requires the user to carry out an authentication procedure, and displays a message generated by the user notification section 85. Further, the user interface section 69 receives (i) an user's operation carried out in response to a request or message from the MFP 1 and (ii) an instruction given from the user.

The network interface section 68 exchanges information with various devices connected to the MFP 1 via the LAN. For example, the network interface section 68 receives, via the network, data (e.g., print data) sent from the user (the user terminal 103 operated by the user), and exchanges information with a database in cases where the fee-charging process described later is carried out.

Moreover, the MFP 1 can exchange information with a plurality of user terminals 103 and other MFPs via the network.

(Explanation of Operation in the Apparatus: Detail of the Printing Permission/prohibition Judging Section 81)

The following fully explains the print job managing section 80 described above. As shown in FIG. 1, the print job managing section 80 includes the printing permission/prohibition judging section 81, the wireless tag data storage section 82, the clock 84, and the output job queue 83.

Figure 3:
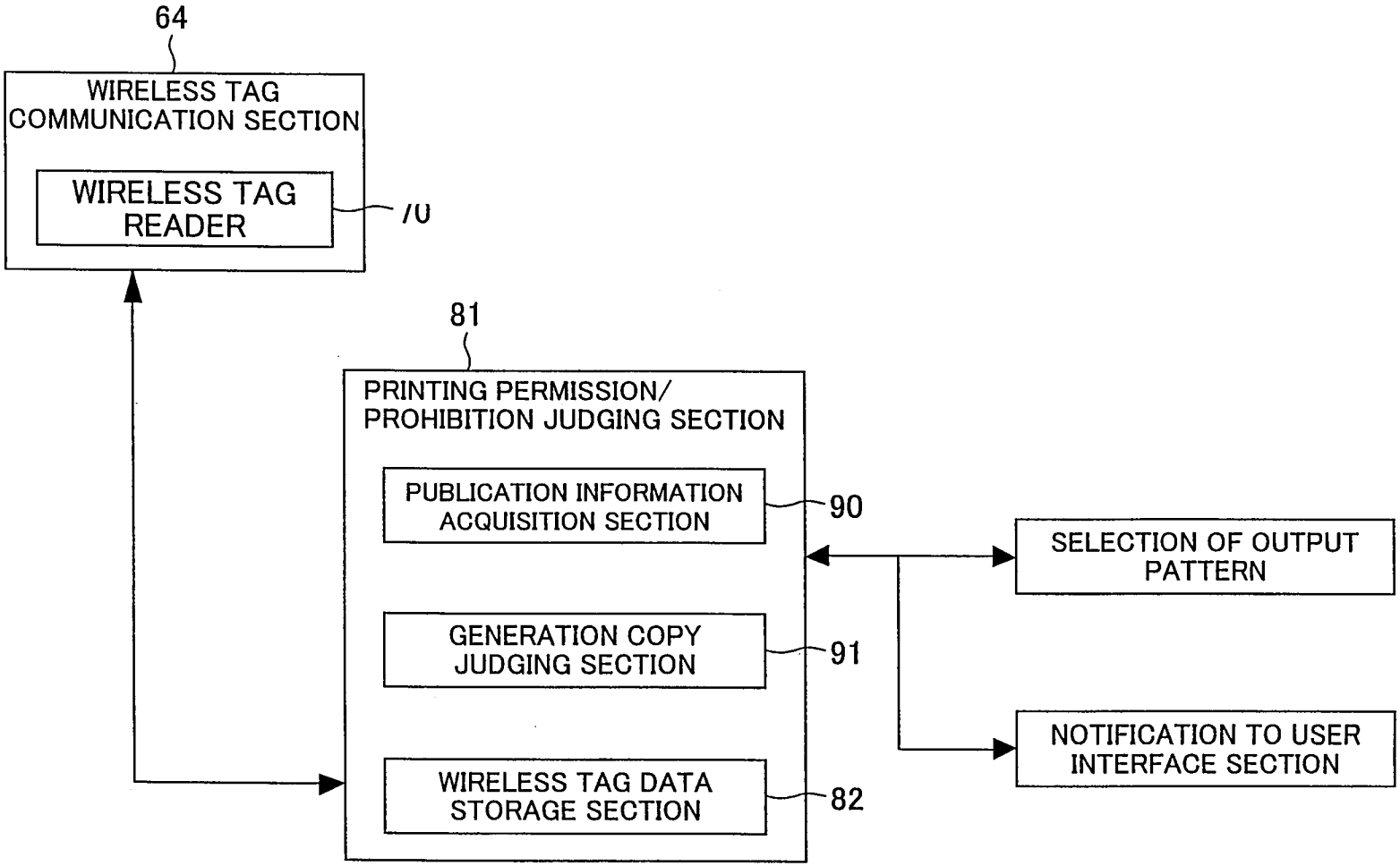
FIG. 3 is a functional block diagram explaining an arrangement of a printing permission/prohibition judging section.

FIG. 3 is a functional block diagram explaining an arrangement of the printing permission/prohibition judging section 81. As shown in FIG. 3, the printing permission/prohibition judging section 81 includes a publication information acquisition section 90, a generation copy judging section 91, and the wireless tag data storage section 82.

The publication information acquisition section 90 acquires (extracts) publication information from the data (produced work information) stored in the wireless tag storage section 82. Further, the generation copy judging section 91 acquires (extracts) the generation copy information from the data (produced work information) stored in the wireless tag storage section 82, and judges whether or not the document 101 having the information tag 102 storing the produced work information is a generation copy, i.e., whether or not the document 101 is a master copy (original).

Then, in cases where the printing source material is a produced work such as the document 101, the printing permission/prohibition judging section 81 acquires the data read out by the wireless tag reader 70 of the wireless tag communication section 64, and stores the data in the wireless tag data storage section 82. Then, the publication information acquisition section 90 extracts the publication information from the produced work information stored in the wireless tag data storage section 82, and judges whether or not the document 101 to be scanned is a produced work, i.e., whether or not the image forming section 3 is conditionally permitted to carry out the image forming process. Further, the generation copy judging section 91 acquires the generation copy information from the produced work information, and judges whether or not the document 101 to be scanned is a material directly copied from a produced work (whether the document 101 is a generation copy), i.e., whether or not the image forming process to be carried out by the image forming section 3 is permitted. Then, in cases where the document 101 is judged to be a produced work, the printing permission/prohibition judging section 81 instructs the output paper sheet selection section 63 to select the wireless-tag-containing recording paper sheet as a paper sheet on which the image is to be formed by the image forming section 3. Further, in cases where the document 101 to be scanned is a generation copy, i.e., in cases where the copying based on the document 101 is prohibited, the printing permission/prohibition judging section 81 uses the user notification section 85 so as to cause the user interface section 69 to display information indicating that the image forming section 3 cannot be so operated as to form (copy) an image, with the result that the information is conveyed to the user. Further, also in cases where the copying is permitted, the printing permission/prohibition judging section 81 uses the user notification section 85 so as to cause the user interface section 69 to display information indicating that the copying is permitted, with the result that the information is conveyed to the user.

(Produced Work Information)

The following explains the produced work information. FIG. 4 shows a data structure of the produced work information. As shown in FIG. 4, the produced work information includes at least the publication information and the generation copy information. Further, the produced work information herein includes owner information.

The publication information is restriction information for restricting the image formation to be carried out based on the document 101, i.e., regulatory information for regulating a process of copying the document 101 having the information tag 102 storing the publication information. That is, the publication information is information indicating whether the process of copying the document 101 having the publication information is permitted to be carried out unlimitedly or limitedly. Specifically, in cases where the document 101 is a book, examples of the publication information include a title of the book, a name of an author of the book, and a date of publication of the book. Alternatively, the publication information may be, for example, information indicating that the image formation is restricted.

Further, the generation copy information is information indicating whether or not the image formation based on the document 101 is prohibited, i.e., information indicating whether or not the process of copying the document 101 having the information tag 102 storing the generation copy information is prohibited. Specifically, the generation copy information includes at least one of (i) information indicating whether or not copyright protection is made, (ii) generation information, (iii) the number of remaining times printing is permitted, and (iv) the like. Note that the generation information refers to a copy history indicating whether the document 101 is a master copy (original), a copy of the original, a copy of the copy, or the like. Further, the number of remaining times the printing is permitted refers to the number of times the copying process using the document 101 can be carried out.

The owner information is information indicating an owner of the document 101.

(Explanation of Operation in the Apparatus: Main Process Flow)

Figure 5:
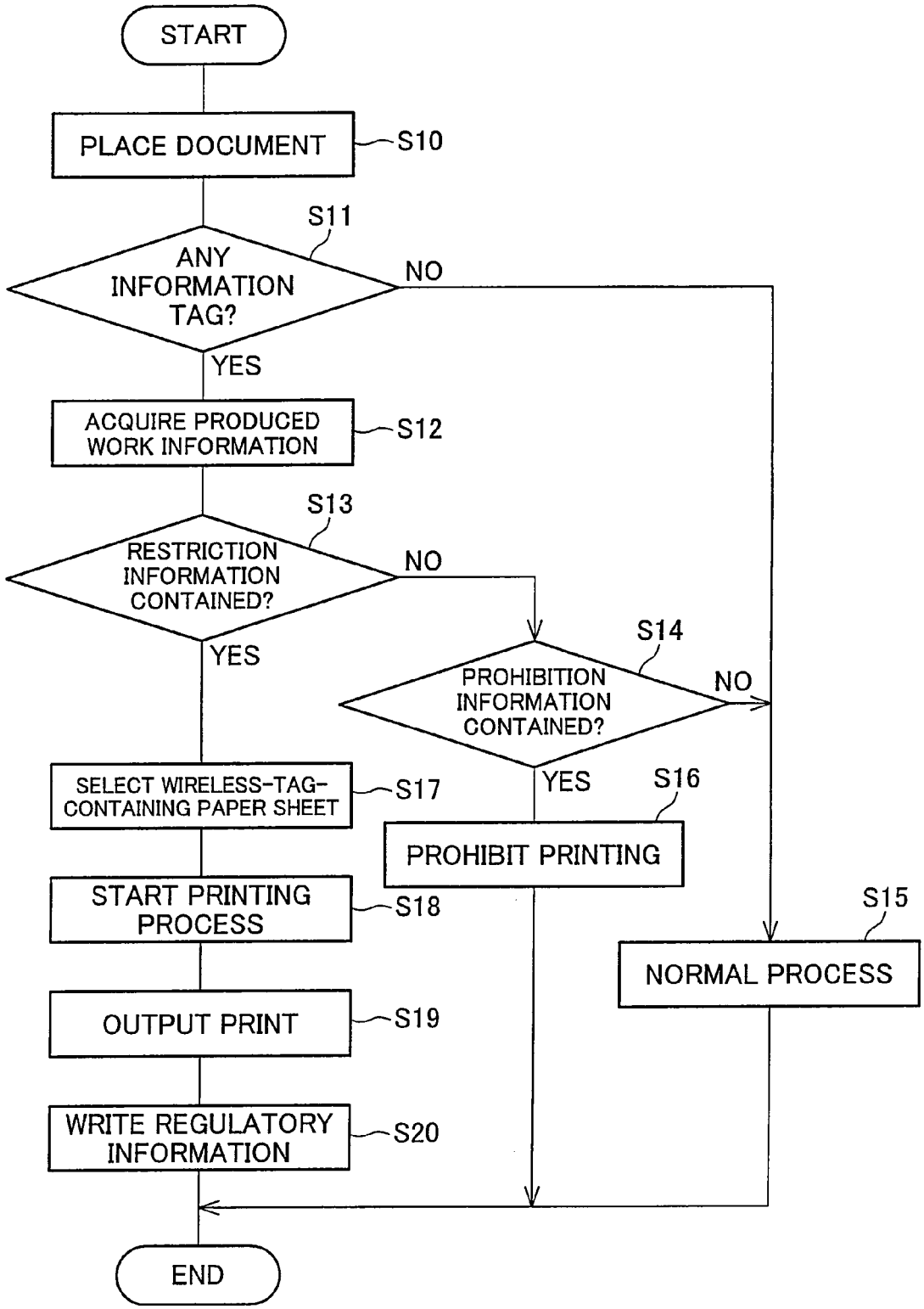
FIG. 5 is a flow chart explaining a copying process of writing the produced work information in a wireless tag of a wireless-tag-containing recording paper sheet.

With reference to a flow chart of FIG. 5, the following explains a flow of the process of writing the produced work information in the wireless tag of the wireless-tag-containing recording paper sheet in cases where the restriction information is contained in the information tag 102 provided in the document 101. FIG. 5 is a flow chart explaining the copying process of writing the produced work information in the wireless tag of the wireless-tag-containing recording paper sheet.

First, the user places a produced work (document 101) such as a book on the document table 21 (S10). Next, in response to the placement of the document 101, the wireless tag communication section 64 judges whether or not the document 101 has the information tag 102 (S11). When the wireless tag communication section 64 judges that the document 101 has no information tag 102 (NO in S11), the document 101 is judged to be a document whose copyright is not generally protected, and the control section 66 carries out a normal process (S15). The normal process refers to a normal copying process (image forming process), which is well-known and details thereof therefore will not be explained.

On the other hand, when the wireless tag communication section 64 has judged in Step S11 that the document 101 has the information tag 102 (YES in S11), the wireless tag communication section 64 operates the wireless tag reader 70 so as to read out the data (produced work information) stored in the information tag 102 provided in the document 101 (S12). Then, the wireless tag communication section 64 transmits, to the printing permission/prohibition judging section 81, the produced work information thus read out.

Upon acquiring the produced work information, the printing permission/prohibition judging section 81 operates the publication information acquisition section 90 so as to judge whether or not the publication information (restriction information) is contained in the produced work information, i.e., in the information tag 102 provided in the document 101 (S13).

When the printing permission/prohibition judging section 81 has judged in Step S13 that the restriction information is not contained (NO in S13), the printing permission/prohibition judging section 81 operates the generation copy judging section 91 so as to judge whether or not the generation copy information (prohibition information) is contained in the produced work information (S14).

Then, when the printing permission/prohibition judging section 81 has judged in Step S14 that the prohibition information is not contained (NO in S14), the process proceeds to S15, and the control section 66 carries out the normal process (normal copying process).

On the other hand, when the printing permission/prohibition judging section 81 has judged in Step S14 that the prohibition information is contained (YES in S14), the printing permission/prohibition judging section 81 notifies the user notification section 85 that the printing is prohibited. Then, the user notification section 85 operates the user interface section 69 so as to notify the user that the printing is prohibited (S16). Then, the process is terminated.

Further, when the printing permission/prohibition judging section 81 has judged in Step S13 that the restriction information is contained (YES in S13), the printing permission/prohibition judging section 81 judges that the printing process can be carried out conditionally (i.e., the printing process can be carried out with respect to the wireless-tag-containing recording paper sheet), the printing permission/prohibition judging section 81 notifies the user notification section 85 that the printing process can be carried out conditionally. Then, the user notification section 85 operates the user interface section 69 so as to notify the user that the printing process can be carried out conditionally. Further, the printing permission/prohibition judging section 81 instructs the output paper sheet selection section 63 to select a wireless-tag-containing recording paper sheet as a recording paper sheet to be subjected to the printing process.

Then, the output paper sheet selection section 63 selects the wireless-tag-containing recording paper sheet in accordance with the instruction given from the printing permission/prohibition judging section 81 (S17). Specifically, the output paper sheet selection section 63 carries out a setting such that the wireless-tag-containing recording paper sheet is supplied from a paper sheet feeding cassette containing the wireless-tag-containing recording paper sheet. Thereafter, the wireless-tag-containing recording paper sheet is transported to the image forming section 3, and the image processing section 61 generates image data based on which an image is to be formed. (S18). Then, the image is formed on the wireless-tag-containing recording paper sheet by the image forming section 3 in accordance with the image data (S19). After Step S19, the wireless-tag-containing recording paper sheet subjected to the image formation is ejected onto the paper sheet ejection tray 51. Then, the printing permission/prohibition judging section 81 transmits, to the wireless tag writer installed on the paper sheet ejection tray 51, the produced work information including (i) the publication information and (ii) the generation copy information. Upon receiving the produced work information, the wireless tag writer 51*a* writes the produced work information as the regulatory information in the wireless tag of the wireless-tag-containing recording paper sheet ejected onto the paper sheet ejection tray 51 (S20). Then, the process is terminated.

Therefore, the produced work information including (i) the publication information and (ii) the generation copy information is stored as the regulatory information in the outputted wireless-tag-containing recording paper sheet. (Note that the owner information may not be stored.) As shown in FIG. 4, examples of the publication information include the title of the book, the name of the author of the book, and the date of publication of the book, and examples of the generation copy information include (a) the information indicating whether or not the copyright protection is made, (b) the generation information, and (c) the number of remaining times printing is permitted. Note that the control section 66 may carry out control such that: the owner information read out from the information tag 102 provided in the produced work is recorded onto the wireless tag of the first generation copy for the sake of tracking down (identifying) the owner of the produced work.

Note that the regulatory information is information for prohibiting or restricting an image forming process to be carried out in accordance with the sheet on which the image has been formed by the image forming section 3.

The foregoing explanation assumes that the produced work information is stored as the regulatory information. However, the produced work information may be information for merely regulating (restricting) a later image forming process. Moreover, in cases where the wireless-tag-containing recording paper sheet having the wireless tag storing the regulatory information is placed as the document 101 on the MFP 1, the regulatory information serves as the restriction information.

Thus, in cases where the restriction information is contained in the information tag 102 provided in the document 101, the wireless-tag-containing recording paper sheet is selected as the paper sheet to be subjected to the printing process, and the produced work information serving as the regulatory information is stored in the wireless tag.

(Explanation of Operation in the Apparatus: Detail of the User Interface Section)

The following explains examples of information displayed by the user interface section 69. FIGS. 6(*a*) to 6(*h*) are diagrams showing the examples of the information displayed by the user interface section 69, respectively.

The user interface section 69 receives, from the user notification section 85, the result of the judgment made by the printing permission/prohibition judging section 81, and displays the result so as to inform the user of the result. Specifically, for example, in cases where the printing permission/prohibition judging section 81 judges that the copying to be carried out is copying of a produced work (i.e., that the restriction information is contained), the user interface section 69 causes its display section to display information indicating that printing for the copying is permitted as shown in FIG. 6(*a*). Further, also in cases where the printing permission/prohibition judging section 81 judges that the produced work information contains neither the restriction information nor the prohibition information, the user interface section 69 only needs to display such information as that shown in FIG. 6(*a*). Further, the user interface section 69 may be arranged as follows. That is, as shown in FIG. 6(*b*), the user interface section 69 causes its display section to display not only the information indicating that printing is permitted, but also the associated information such as the publication information and the generation copy information both of which are stored in the information tag 102. The associated information is displayed on the display section of the user interface section 69 as shown in FIG. 6(*c*) and FIG. 6(*d*) by pressing displayed items which respectively indicate "PUBLICATION INFORMATION" and "COPY INFORMATION".

On the other hand, in cases where the printing permission/prohibition judging section 81 has judged that the document 101 is a generation copy from which no copy is allowed to be made (i.e., that the prohibition information is contained), the user interface section 69 displays information indicating that printing is prohibited as shown in FIG. 6(*e*). Further, the user interface section 69 may be arranged as follows. That is, as shown in FIG. 6(*f*), the user interface section 69 displays not only the information indicating that printing is prohibited, but also the associated information such as the publication information shown in FIG. 6(*g*) and the generation copy information shown in FIG. 6(*h*) both of which are stored in the information tag 102. In FIG. 6(*h*), the user interface section 69 displays a message that induces the user to make a copy from the original.

Note that the print data processing section 75 may judge, by analyzing the image data acquired by the image scanning section 2, whether or not the image data contains the copy restriction code/pattern. This will be described later.

Example 2

The following explains another example. An MFP 1 according to Example 2 is arranged so as not to have the wireless tag writer 51*a* installed on the paper sheet ejection tray 51 of the MFP 1 described in Example 1. Specifically, the MFP 1 is arranged such that: in cases where a copy of a produced work is made, the output paper sheet selection section 63 selects a wireless-tag-containing recording paper sheet having a wireless tag in which the regulatory information has been written in advance. In this case, unlike in the case of the MFP 1 of Example 1, there is no need to install the wireless tag writer 51*a* on the paper sheet ejection tray 51. This not only simplifies the process, but also brings about an advantage in terms of cost.

In the following, for convenience of explanation, components having the same function as those shown in Example 1 are given the same reference numerals, and will not be explained.

Figure 7:
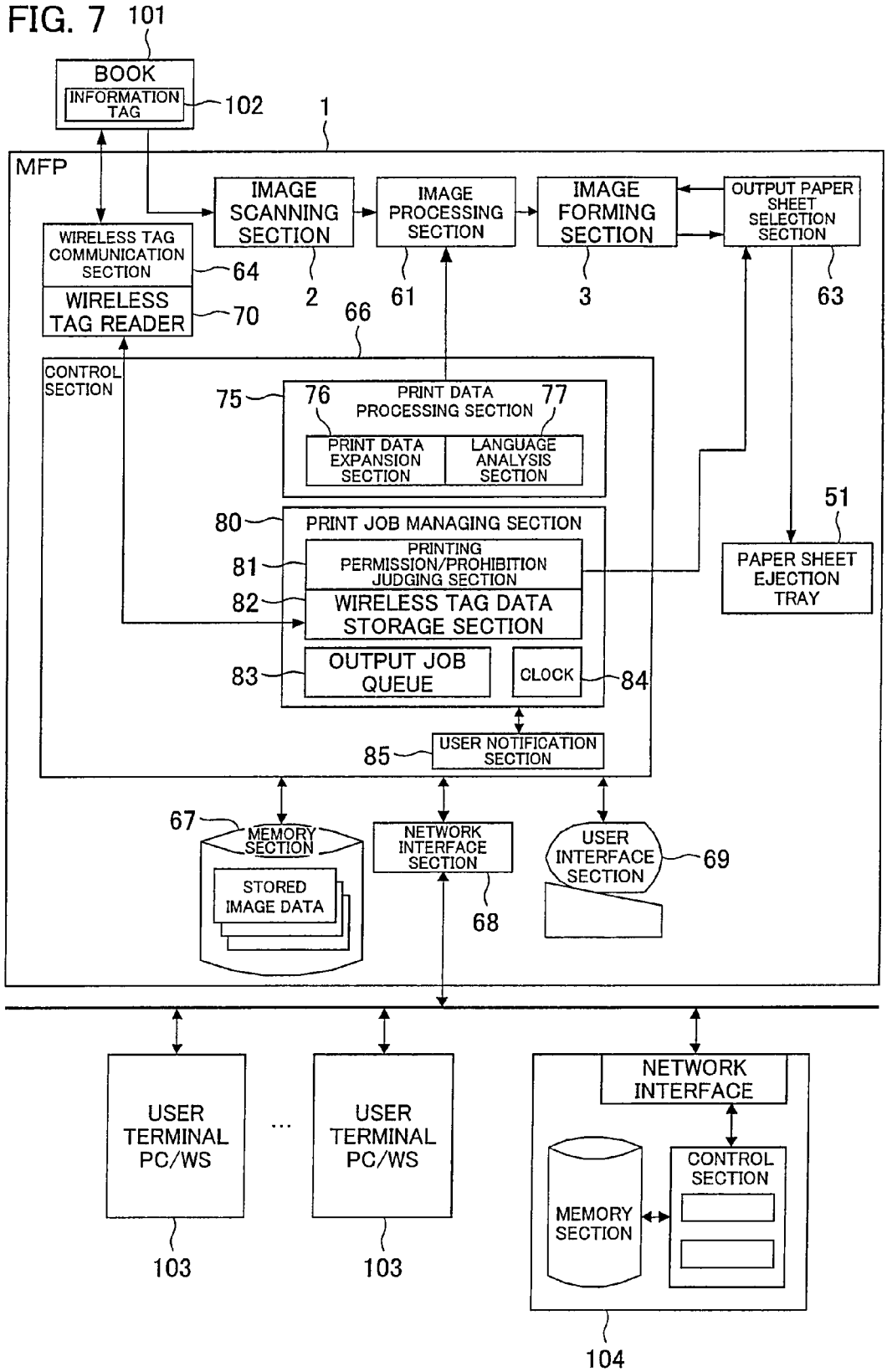
FIG. 7 is a block diagram schematically showing an arrangement of an MFP according to Examples 2 and 4.

FIG. 7 is a block diagram schematically showing the arrangement of the MFP 1 according to Example 2. As shown in FIG. 7, the MFP 1 according to Example 2 includes the wireless tag communication section 64, the image scanning section 2, the image processing section 61, the image forming section 3, the control section 66, the memory section 67, the user interface section 69, the network interface section 68, the output paper sheet selection section 63, and the paper sheet ejection tray 51.

Moreover, in Example 2, in cases where the restriction information is contained in the information tag 102 provided in the document 101, the wireless-tag-containing recording paper sheet having the wireless tag in which the regulatory information for restricting the copy operation is stored in advance is selected and is subjected to an image forming process (printing process).

Figure 8:
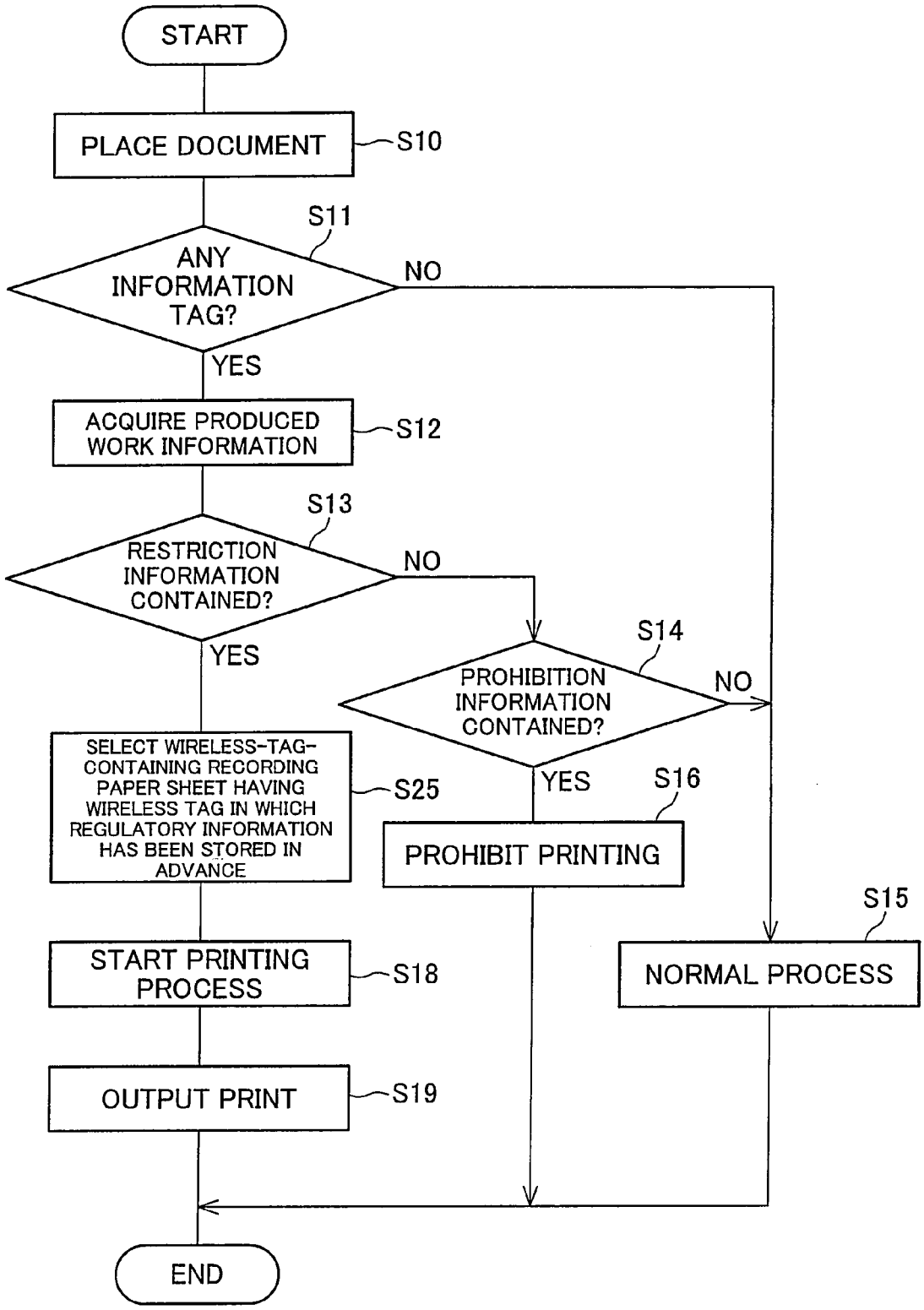
FIG. 8 is a flow chart explaining a printing process of carrying out image formation with respect to a wireless-tag-containing recording paper sheet having a wireless tag in which regulatory information has been stored in advance.

FIG. 8 is a flow chart explaining a printing process of carrying out image formation with respect to the wireless-tag-containing recording paper sheet in which the regulatory information has been stored in advance. In the following, for convenience of explanation, components and steps identical to those shown in Example 1 are given the same numbers, and will not be explained.

In Steps S10 through S12, the wireless tag communication section 64 judges whether or not the document 101 based on which the image formation (copying) is carried out has the information tag 102. In cases where the document 101 has the information tag 102, the data stored in the information tag 102 is read out and then is transmitted to the wireless tag data storage section 82 of the print job managing section 80.

Then, when the printing permission/prohibition judging section 81 has judged, in Step S13, that the restriction information is contained (YES in S13), the printing permission/prohibition judging section 81 judges that the printing process can be carried out conditionally (i.e., the printing process can be carried out with respect to a wireless-tag-containing recording paper sheet), and notifies the user notification section 85 that the printing process can be carried out conditionally. Then, the user notification section 85 operates the user interface section 69 so as to notify the user that the printing process can be carried out conditionally. Further, the printing permission/prohibition judging section 81 instructs the output paper sheet selection section 63 to select, as a recording paper sheet to be subjected to the printing process, a wireless-tag-containing recording paper sheet having a wireless tag in which the regulatory information has been stored in advance (S25).

Then, the output paper sheet selection section 63 selects, in accordance with the instruction given from the printing permission/prohibition judging section 81, the wireless-tag-containing recording paper sheet having the wireless tag in which the regulatory information has been stored in advance. Thereafter, the wireless-tag-containing recording paper sheet is transported to the image forming section 3, and the image processing section 61 generates image data based on which an image is to be formed (S18). Then, the image is formed on the wireless-tag-containing recording paper sheet by the image forming section 3 (S19). Then, the process is terminated.

Thus, in Example 2, the recording of the produced work information is not carried out with respect to the wireless tag of the wireless-tag-containing recording paper sheet subjected to the image formation, but the wireless-tag-containing recording paper sheet having the wireless tag in which the regulatory information has been stored in advance is subjected to the printing process.

In Example 2, the regulatory information refers to information for regulating a later image forming process. That is, instead of the produced work information indicating information concerning the document 101, the wireless tag in which the regulatory information has been stored in advance only needs to store the regulatory information for regulating an image forming process that is supposed to be carried out based on the output material on which the image has been formed by the image forming section 3 (i.e., based on the wireless-tag-containing recording paper sheet on which the image has been formed).

Further, for example, the publication information and the generation copy information of the data stored in the information tag 102 of the document 101 can be previously recorded as the regulatory information by another device onto the wireless tag of the wireless-tag-containing recording paper sheet. The generation copy information serves as the prohibition information.

The foregoing explanation assumes that the wireless-tag-containing recording paper sheet having the wireless tag in which the regulatory information has been stored in advance is used. However, it is possible to use a wireless-tag-containing recording paper sheet having a wireless tag in which prohibition information for completely prohibiting generation copying is stored in advance instead of the regulatory information.

Example 3

The following explains further another example. An MFP 1 according to Example 3 is arranged so as to include a copy restriction code/pattern generation section 92 instead of (i) the output paper sheet selection section and (ii) the wireless tag writer 51*a* installed on the paper sheet ejection tray 51, both of which are described in Example 1. Moreover, in cases where printing for copying the document 101 is permitted, the MFP 1 according to Example 3 (a) generates a copy restriction code/pattern, (b) combines the copy restriction code/pattern with print data in the image forming section 3, and (c) forms, on a recording paper sheet, an image obtained through the combining. When one attempts to make a copy of the document 101 by using, as a master copy, the printed material thus obtained, the MFP 1 recognizes the copy restriction code/pattern and restricts the printing. This makes it possible to prevent propagation of the generation copying.

For convenience of explanation, components having the same function as those shown in Example 1 are given the same reference numerals, and will not be explained.

Figure 9:
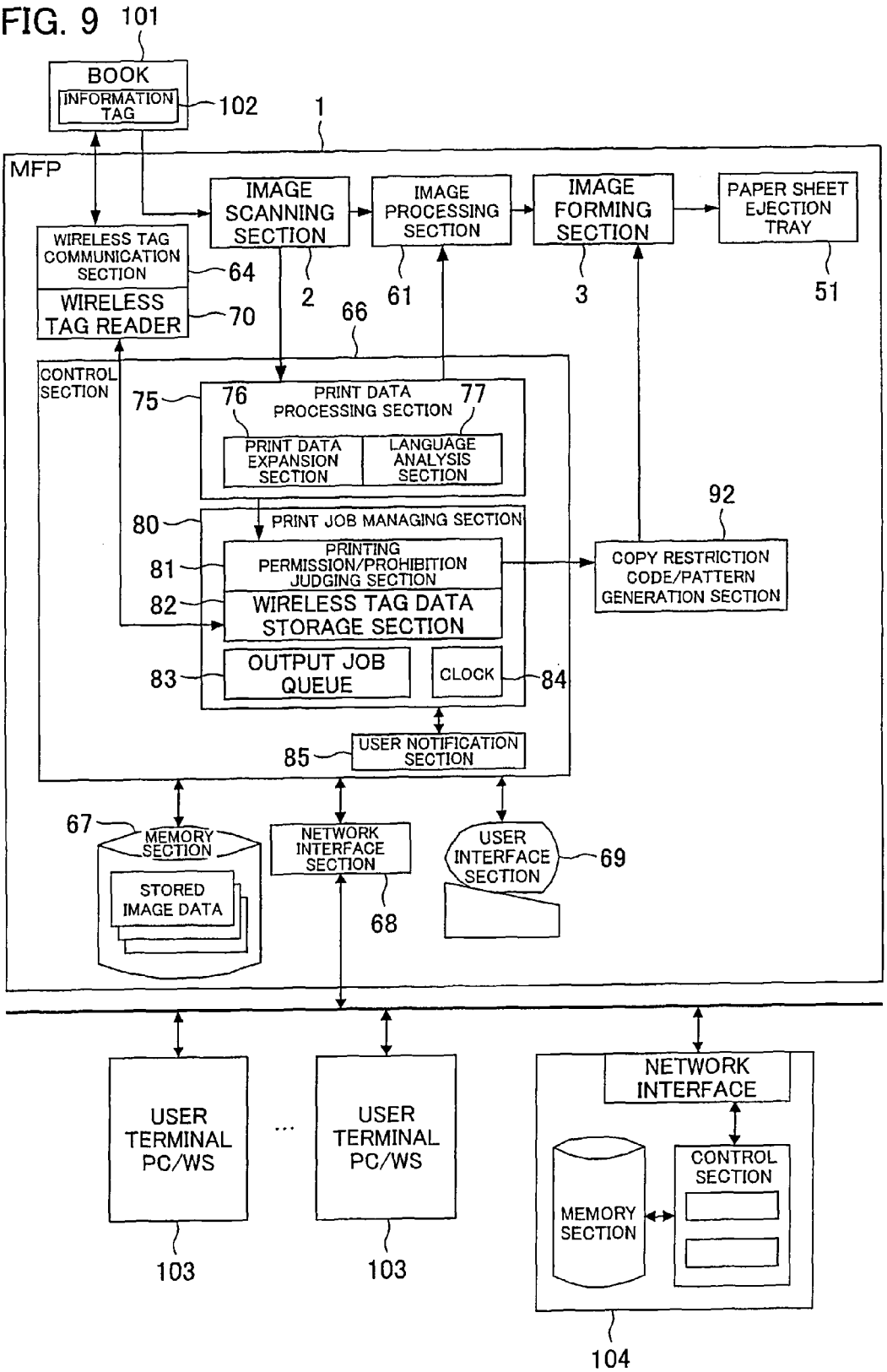
FIG. 9 is a block diagram schematically showing an arrangement of an MFP according to Example 3.

FIG. 9 is a block diagram schematically showing the arrangement of the MFP 1 according to Example 3. The MFP 1 according to Example 3 includes the wireless tag communication section 64, the image scanning section 2, the image processing section 61, the image forming section 3, the control section 66, the memory section 67, the user interface section 69, the network interface section 68, the copy restriction code/pattern generation section 92, and the paper sheet ejection tray 51.

Upon forming an image by using the image forming section 3, the copy restriction code/pattern generation section 92 generates a copy restriction code/pattern (regulatory information) to be inserted in the image. That is, in Example 3, the copy restriction code/pattern is supposed to be printed on the recording paper sheet on which the image is to be formed in accordance with the image data read out by the image scanning section 2.

Moreover, in Example 3, in cases where the document 101 has no information tag 102, it is judged whether or not the copy restriction code/pattern is contained in the image data obtained through the scanning carried out by the image scanning section 2. Specifically, the image data obtained through the scanning carried out by the image scanning section 2 is transmitted to the print data processing section 75, and the print data processing section 75 judges whether or not the copy restriction code/pattern is contained in the image of the document 101. Note that the judgment whether or not the copy restriction code/pattern is contained in the image is carried out by either (i) scanning a bar code in cases where the copy restriction code/pattern is recorded in the form of a bar code, or (ii) carrying out the OCR processing or the like in cases where the copy restriction code/pattern is recorded in the form of a language.

Then, the print data processing section 75 judges whether or not the copy restriction code/pattern is contained in the image data obtained through the scanning carried out by the image scanning section 2, and the result of the judgment is transmitted to the printing permission/prohibition judging section 81. Then, in cases where the copy restriction code/pattern is contained, the printing permission/prohibition judging section 81 decides that the printing for copying the document 101 is not carried out. Further, the printing permission/prohibition judging section 81 operates the user notification section 85 so as to cause the user interface section 69 to display information indicating that the printing cannot be carried out. Then, in response to the decision made by the printing permission/prohibition judging section 81, i.e., the decision that the printing is not carried out, the control section 66 prohibits an image forming process that is supposed to be carried out based on the image data obtained through the scanning carried out by the image scanning section 2 and containing the copy restriction code/pattern.

Figure 10:
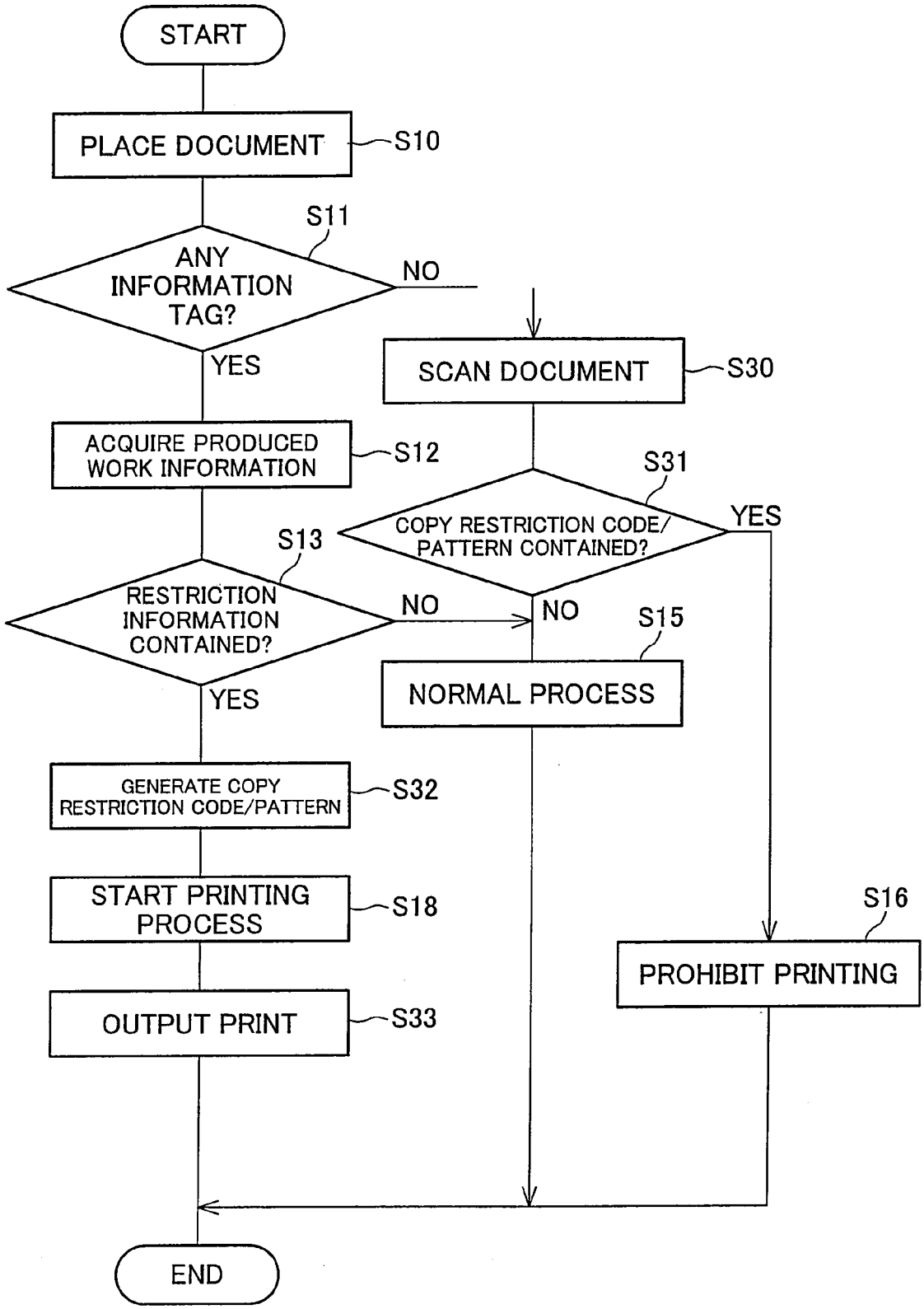
FIG. 10 is a flow chart explaining a printing process of (i) judging whether or not a copy restriction code/pattern is contained in a document and (ii) forming regulatory information as an image on a recording paper sheet when image formation is carried out.

FIG. 10 is a flow chart explaining a printing process of (i) judging whether or not the copy restriction code/pattern is contained in the document 101 and (ii) forming the regulatory information as an image on a recording paper sheet when the image formation is carried out. In the following, for convenience of explanation, components and steps identical to those shown in Example 1 are given the same numbers, and will not be explained.

In Step S10, the user places the document 101 on the document table 21. Then, the wireless tag communication section 64 judges whether or not the document 101 has the information tag 102 (S11). In cases where it is has been judged in Step S11 that the document 101 has the information tag 102, the data (produced work information) stored in the information tag 102 is read out by the wireless tag reader 70 so as to be stored in the wireless tag data storage section 82 of the print job managing section 80 (S12).

Then, the printing permission/prohibition judging section 81 judges whether or not the restriction information is contained in the produced work information (S13).

When the printing permission/prohibition judging section 81 has judged in Step S13 that the restriction information is contained (YES in S13), the printing permission/prohibition judging section 81 instructs the copy restriction code/pattern generation section 92 to generate a copy restriction code/pattern. Then, the copy restriction code/pattern generation section 92 generates a copy restriction code/pattern in accordance with the instruction, and transmits the copy restriction code/pattern to the image forming section 3 (S32). Then, the printing process is started (S18). The image forming section 3 forms an image in accordance with the image data generated by the image processing section 61, and forms the copy restriction code/pattern as an image (S33). That is, the image thus outputted contains the copy restriction code/pattern. Then, the printed material thus outputted is ejected onto the paper sheet ejection tray 51.

On the other hand, when it is judged in Step 11 that the document 101 has no information tag 102 (NO in S11), the image scanning section 2 acquires image data from the document 101 (S30). Then, the image data thus acquired is transmitted to the print data processing section 75. Then, the print data processing section 75 judges whether or not the image data contains a copy restriction code/pattern (S31).

Then, the result of the judgment made by the print data processing section 75 is transmitted to the printing permission/prohibition judging section 81. Then, when it is judged in Step 31 that the copy restriction code/pattern is contained (YES in S31), the printing permission/prohibition judging section 81 notifies the user notification section 85 that the printing is prohibited. Then, the user notification section 85 operates the user interface section 69 so as to notify the user that the printing is prohibited (S16).

On the other hand, when it is judged in Step S31 that the copy restriction code/pattern is not contained (NO in S31), the process proceeds to Step S15.

The foregoing explanation assumes that (i) the data (image data) of the image to be printed and (ii) the copy restriction code/pattern are combined in the image forming section 3 and are outputted. However, for the purpose of completely prohibiting the generation copying, a copy prohibition code/pattern may be combined with the image data.

That is, when it is judged in Step S31 that the copy restriction code/pattern is contained (YES in S31), the process may proceed to Step S32. In cases where the copy restriction code/pattern is a copy prohibition code/pattern, the process may proceed to Step S16.

Example 4

The following explains further another example. An MFP 1 according to Example 4 is arranged such that: a paper sheet on which a copy restriction code/pattern has been recorded in advance is selected as a recording paper sheet so that an output material containing regulatory information is outputted. That is, in case of making a copy of a produced work, the output paper sheet selection section 63 selects a recording paper sheet on which the copy restriction code/pattern has been printed in advance. Further, in case of making a copy of the produced work from the copy of the produced work, i.e., from the sheet on which the copy restriction code/pattern is provided in the form of an image, the image scanning section 2 of the MFP 1 recognizes the copy restriction code/pattern, and the printing for the copying is restricted. This makes it possible to prevent propagation of the generation copying.

FIG. 7 is a block diagram schematically showing the arrangement of the MFP 1 according to Example 4. As shown in FIG. 7, the MFP 1 includes the wireless tag communication section 64, the image scanning section 2, the image processing section 61, the image forming section 3, the control section 66, the memory section 67, the user interface section 69, the network interface section 68, the output paper sheet selection section 63, and the paper sheet ejection tray 51.

Figure 11:
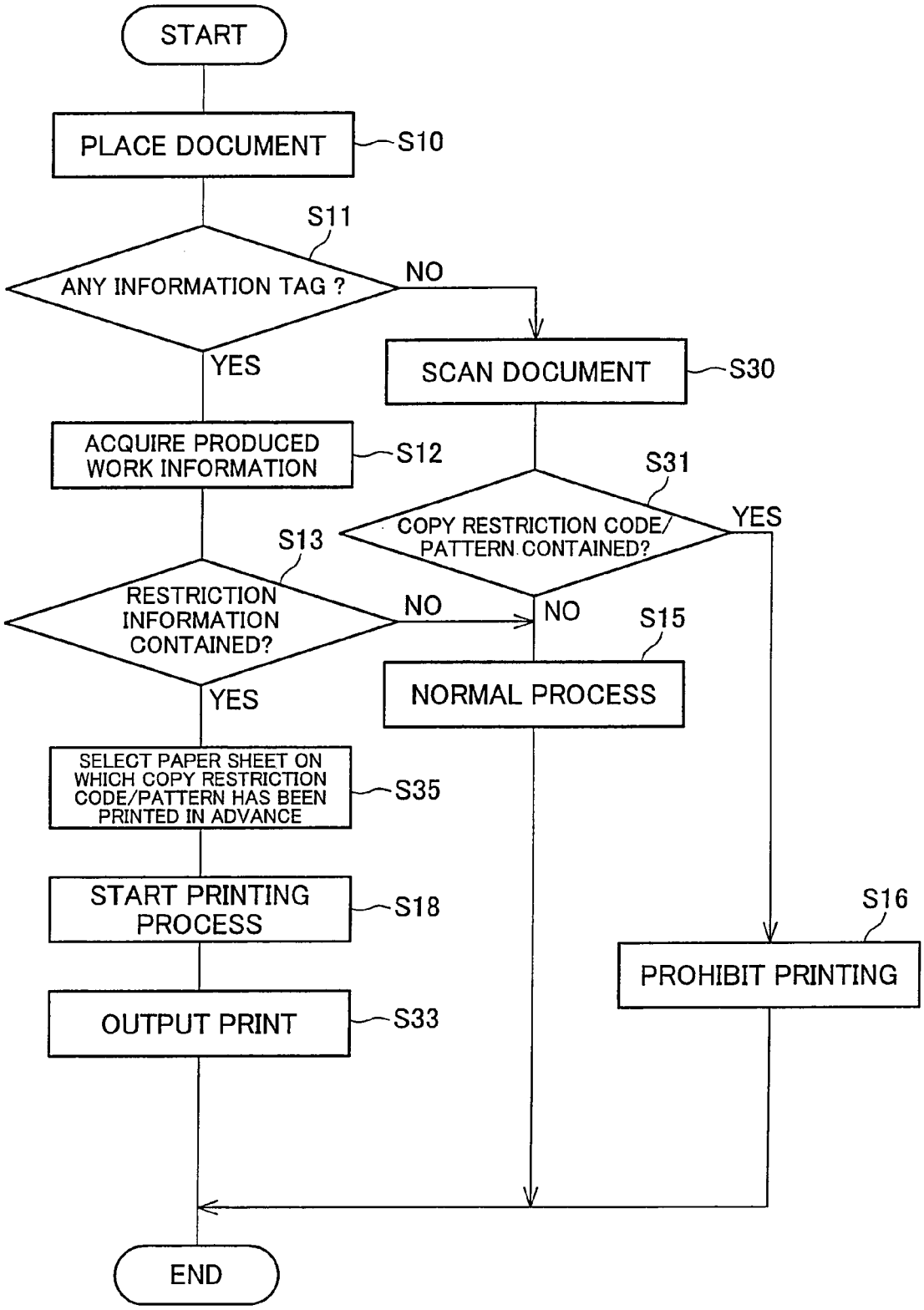
FIG. 11 is a flow chart for explaining a printing process of carrying out, when a document has restriction information, image formation by using a recording paper sheet on which a copy restriction code/pattern has been printed in advance.

FIG. 11 is a flow chart explaining a printing process of carrying out, in cases where the document 101 has restriction information, image formation by using a recording paper sheet on which a copy restriction code/pattern has been printed in advance. In the following, for convenience of explanation, components and steps identical to those shown in Examples 1 to 3 are given the same numbers, and will not be explained.

In Steps S10 through S12, in cases where the document 101 placed on the document table 21 has the information tag 102, the produced work information stored in the information tag 102 is recorded onto the wireless tag data storage section 82. Then, the printing permission/prohibition judging section 81 judges whether or not the restriction information is contained in the produced work information stored in the wireless tag data storage section 82 (in the data stored in the information tag 102) (S13).

When the printing permission/prohibition judging section 81 judges in Step S13 that the restriction information is contained (YES in S13), the printing permission/prohibition judging section 81 instructs the output paper sheet selection section 63 to select, as a paper sheet to be subjected to the image formation, a recording paper sheet on which the copy restriction code/pattern has been printed in advance (S35). Thereafter, the printing process is started (S18). The output paper sheet selection section 63 selects, in accordance with the instruction given from the printing permission/prohibition judging section 81, the recording paper sheet on which the copy restriction code/pattern has been printed in advance. The recording paper sheet is transported to the image forming section 3. Then, the image forming section 3 forms an image on the recording paper sheet on which the copy restriction code/pattern has been printed in advance (S33). Then, the printed material subjected to the image formation is ejected onto the paper sheet ejection tray 51. Thus, the process is terminated.

In the foregoing explanation, the recording paper sheet on which the copy restriction code/pattern has been printed in advance is used. However, for the purpose of completely prohibiting the generation copying, a recording paper sheet on which a copy prohibition code/pattern has been printed in advance may be used, for example.

Further, in the foregoing explanation, in cases where it has been judged in Step S31 that the copy restriction code/pattern is contained in the document 101, the process of prohibiting the printing is carried out. However, the present invention is not limited to this. For example, in cases where the copy restriction code/pattern is contained in the document 101, the image formation may be carried out in accordance with any one of the following methods (A) through (D) respectively corresponding to Steps S17, S25, S32, and S35: (A) after forming the image on the wireless-tag-containing recording paper sheet having the wireless tag, the regulatory information is recorded onto the wireless tag; (B) the image is formed on the wireless-tag-containing recording paper sheet having the wireless tag in which the regulatory information has been stored in advance; (C) the image and the copy restriction code/pattern are printed together; and (D) the image is formed on the recording paper sheet on which the copy restriction code/pattern has been printed in advance. That is, in FIG. 11, when it is judged in Step S31 that the copy restriction code/pattern is contained (YES in S31), the process may proceed to Step S35. Further, in cases where the copy restriction code/pattern is the copy prohibition code/pattern for prohibiting the generation copying, it may be judged in Step 31 that the copy restriction code/pattern is contained (YES in S31), and the process may proceed to Step 16.

Example 5

The following explains further another example. An MFP according to Example 5 is arranged such that: in cases where the restriction information is contained in the information tag 102 provided in the document 101, the copy restriction code/pattern is formed in the form of an image on a wireless-tag-containing recording paper sheet at the same time as an image formed on the document 101 is formed on the wireless-tag-containing recording paper sheet.

This arrangement makes it possible to deal with a case where either one of the information tag 102 and the copy restriction code/pattern cannot be used. An example of the case is a case where breakage of the information tag 102 makes it impossible to read out the information stored in the information tag 102. Another example is a case where the copy restriction code/pattern cannot be formed as an image. Further, with this arrangement, for example, the information tag 102 is used to store the publication information, whereas the copy restriction code/pattern is used as a measure of controlling the generation copying. With the arrangement of Example 5, for example, the copy restriction code/pattern is provided in the printed material copied from the produced work. Therefore, even in cases where the wireless tag is removed from the printed material, the MFP 1 can restrict the printing when recognizing the copy restriction code/pattern. This makes it possible to prevent propagation of the generation copying. Further, Example even in cases where trouble caused, for example, by toner shortage during the printing makes it impossible to properly form the copy restriction code/pattern as an image, the produced work information and/or the generation copy information is stored in the wireless tag. Therefore, even in cases where the MFP 1 cannot properly recognize the copy restriction code/pattern, the MFP 1 can restrict the printing in accordance with the information stored in the wireless tag. This will be described below.

Figure 12:
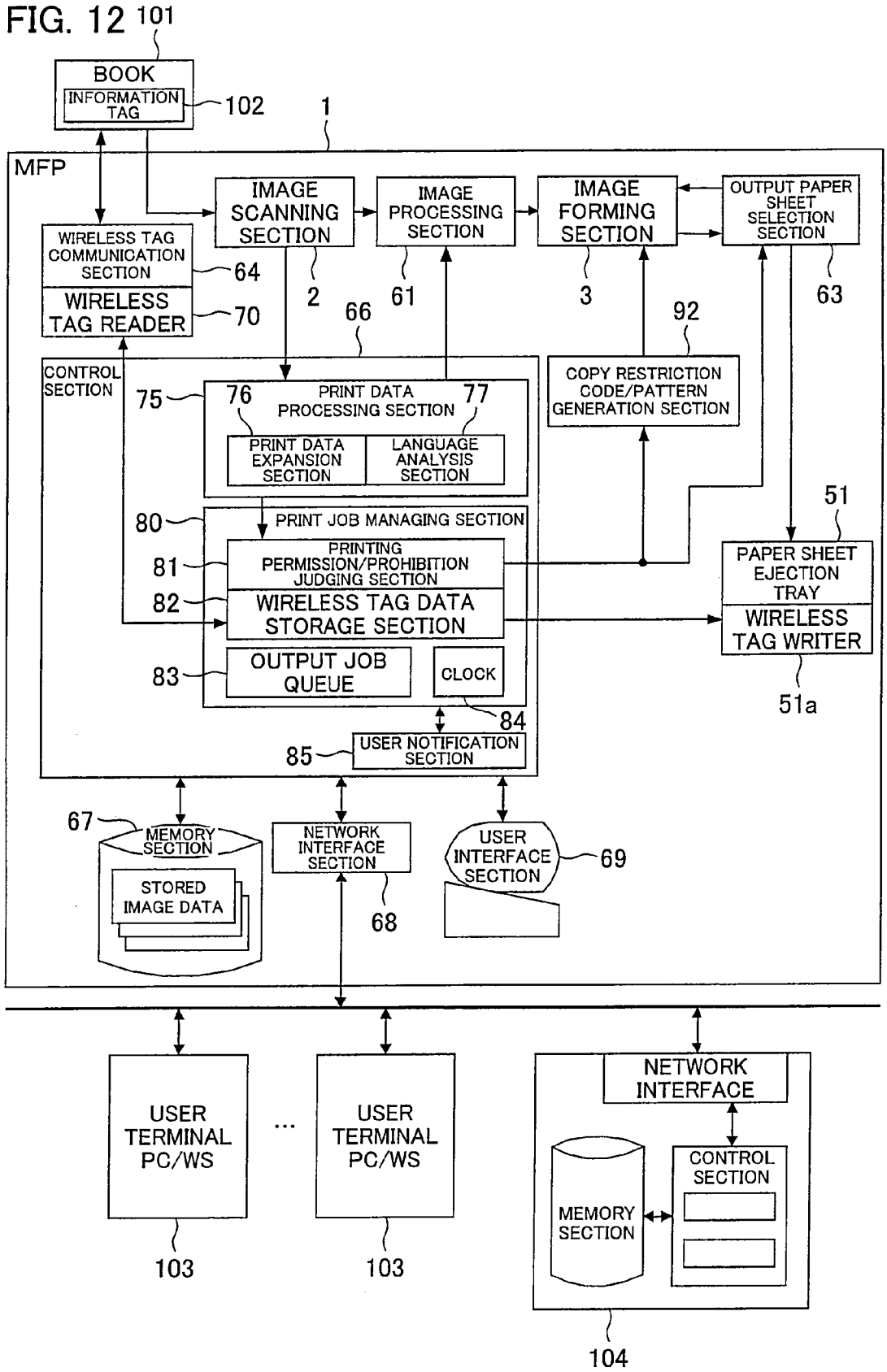
FIG. 12 is a block diagram schematically showing an arrangement of an MFP according to Example 5.

FIG. 12 is a block diagram schematically showing the arrangement of the MFP 1 according to Example 5. As shown in FIG. 12, the MFP 1 includes the wireless tag communication section 64, the image scanning section 2, the image processing section 61, the image forming section 3, the control section 66, the memory section 67, the user interface section 69, the network interface section 68, the output paper sheet selection section 63, the paper sheet ejection tray 51 provided with the wireless tag writer 51*a*, and the copy restriction code/pattern generation section 92.

Figure 13:
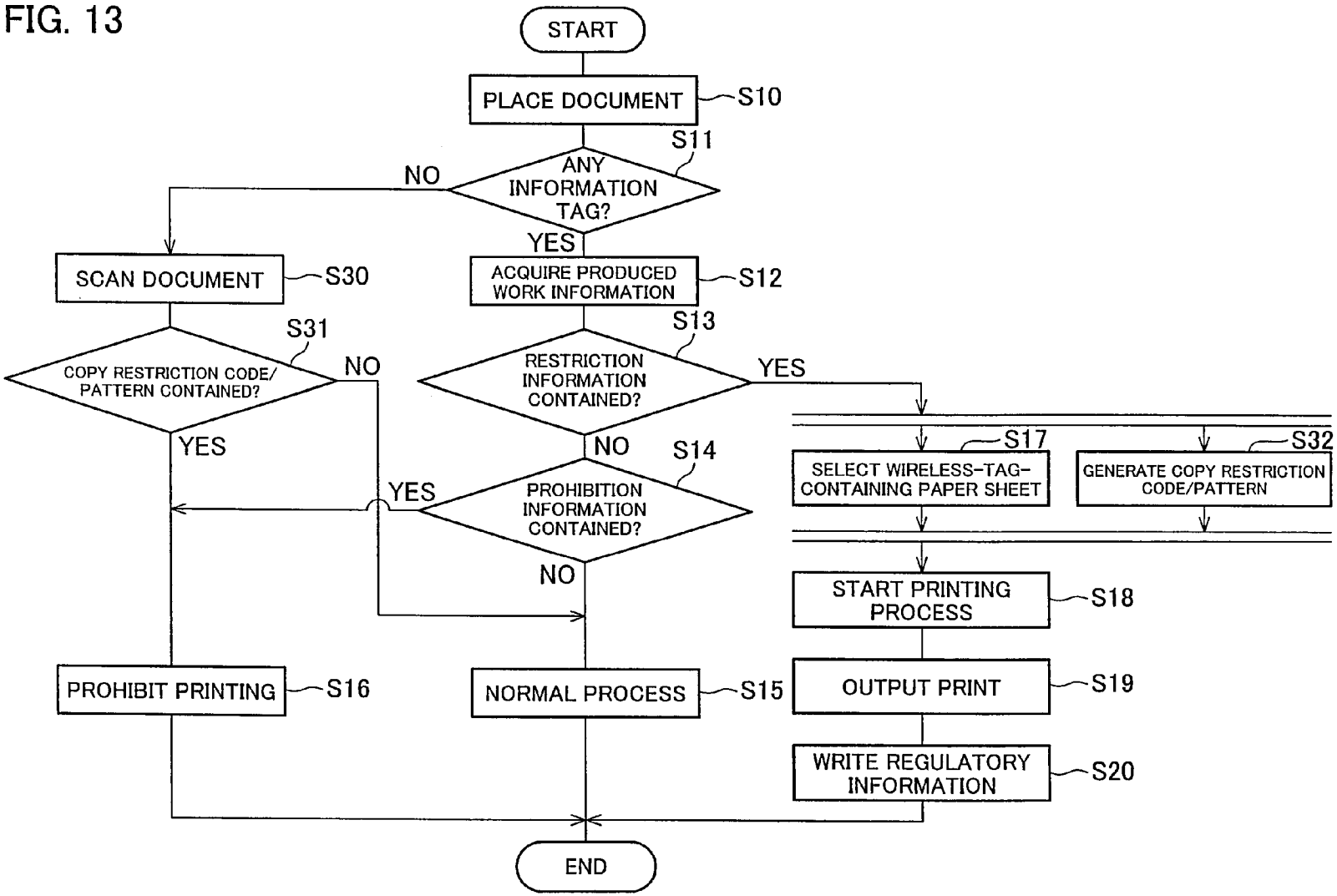
FIG. 13 is a flow chart explaining a printing process in which (i) a wireless-tag-containing recording paper sheet having a wireless tag is used, (ii) data to be used in the printing and a copy restriction code/pattern are combined when image formation is carried out, and (iii) the produced work information or the like is written in the wireless tag of the wireless-tag-containing recording paper sheet.

FIG. 13 is a flow chart explaining a printing process in which (i) a wireless-tag-containing recording paper sheet having a wireless tag is used, (ii) data to be used in the printing and a copy restriction code/pattern are combined when image formation is carried out, and (iii) the produced work information or the like is written in the wireless tag of the wireless-tag-containing recording paper sheet. In the following, for convenience of explanation, components and steps identical to those shown in Examples 1 to 4 are given the same numbers, and will not be explained.

In Steps S10 through S12, in cases where the document 101 placed on the document table 21 has the information tag 102, the produced work information stored in the information tag 102 is stored in the wireless tag data storage section 82. Then, the printing permission/prohibition judging section 81 judges whether or not the restriction information is contained in the produced work information stored in the wireless tag data storage section 82 (S13).

When the printing permission/prohibition judging section 81 has judged in Step S13 that the restriction information is contained (YES in S13), the printing permission/prohibition judging section 81 (i) instructs the output paper sheet selection section 63 to select, as a paper sheet to be subjected to the image formation, a wireless-tag-containing recording paper sheet having the wireless tag, and (ii) commands the copy restriction code/pattern generation section 92 to generate the copy restriction code/pattern. Then, the output paper sheet selection section 63 selects the wireless-tag-containing recording paper sheet in accordance with the instruction given from the printing permission/prohibition judging section 81 (S17). Further, the copy restriction code/pattern generation section 92 generates the copy restriction code/pattern (S32).

Thereafter, the printing process is started (S18). The wireless-tag-containing recording paper sheet selected by the output paper sheet selection section 63 is transported to the image forming section 3. Then, the image forming section 3 acquires image data and the copy restriction code/pattern from the image processing section 61 and the copy restriction code/pattern generation section 92, respectively. In accordance with the image data and the copy restriction code/pattern, the image forming section 3 forms an image containing the copy restriction code/pattern (S19). After Step S19, the wireless-tag-containing recording paper sheet subjected to the image formation is ejected onto the paper sheet ejection tray 51. Then, the printing permission/prohibition judging section 81 transmits, to the wireless tag writer 51*a* installed on the paper sheet ejection tray 51, the produced work information including (i) the publication information and (ii) the generation copy information. Upon receiving the produced work information, the wireless tag writer 51*a* writes the produced work information as regulatory information in the wireless tag of the wireless-tag-containing recording paper sheet ejected onto the paper sheet ejection tray 51 (S20). Then, the process is terminated.

Example 6

The following explains further another example. An MFP according to Example 6 is arranged such that a fee-charging process can be carried out. This can be applied, for example, to a case where: the user uses the MFP 1 so as to make a copy of only desired information from a sample book provided at a convenience store or the like, and is charged a fee for the printing by an appropriate fee-charging process. This will be described below.

Figure 14:
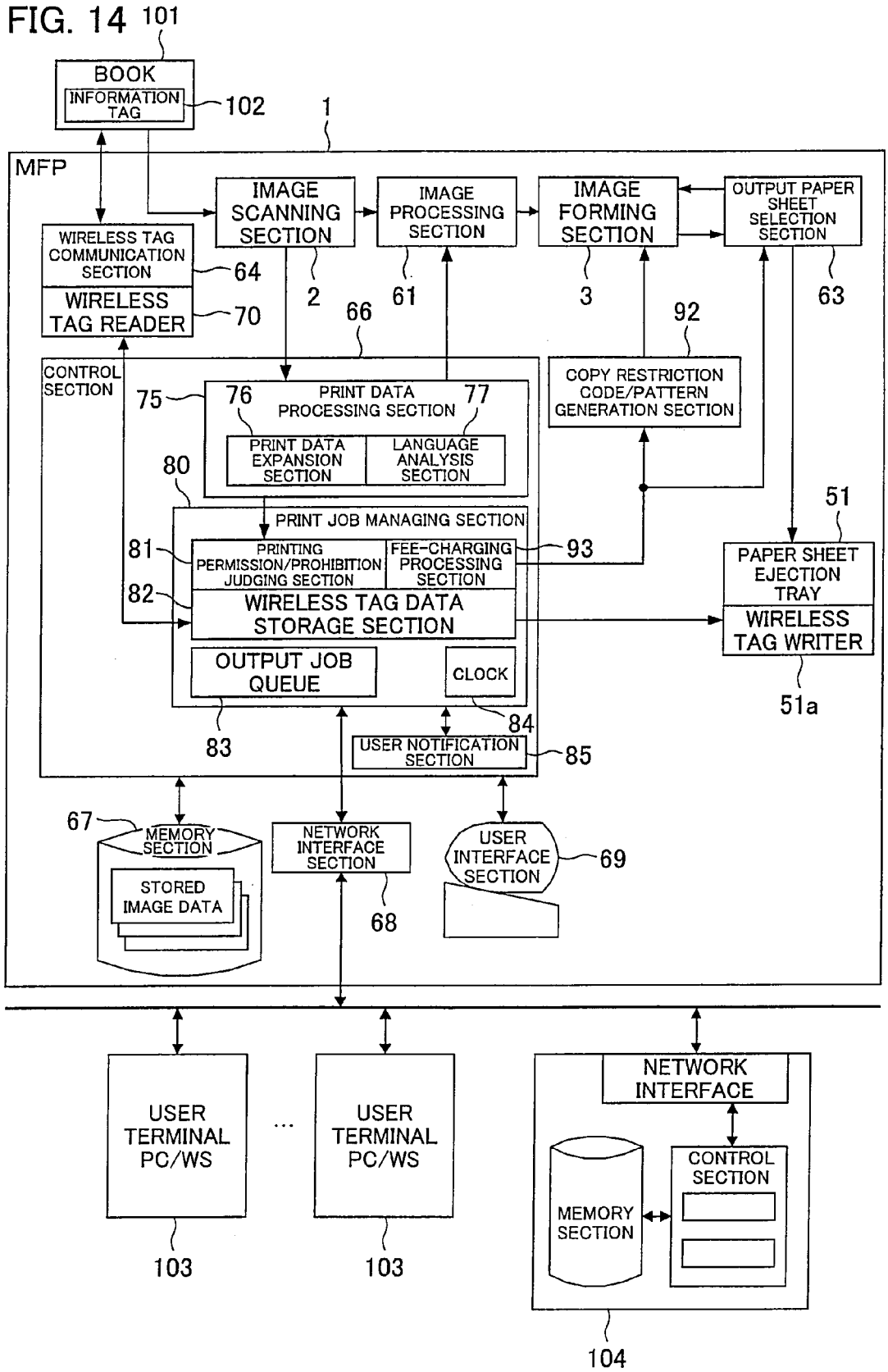
FIG. 14 is a block diagram schematically showing an arrangement of an MFP according to Example 6.

FIG. 14 is a block diagram schematically showing the arrangement of the MFP 1 according to Example 6. As shown in FIG. 14, the MFP 1 includes the wireless tag communication section 64, the image scanning section 2, the image processing section 61, the image forming section 3, the control section 66, the memory section 67, the user interface section 69, the network interface section 68, the output paper sheet selection section 63, the paper sheet ejection tray 51 provided with the wireless tag writer 51*a*, and the copy restriction code/pattern generation section 92. The MFP 1 further includes a fee-charging processing section 93 provided in the print job managing section 80 of the control section 66.

The fee-charging processing section 93 determines a fee amount in accordance with the data which is stored in the wireless tag data storage section 82 and which is acquired from the information tag 102 provided in the document 101, and carries out the fee-charging process per image formation job.

Specifically, the information tag 102 stores fee-charging information for determining the fee amount, and the fee-charging processing section 93 determines the fee amount in accordance with the fee-charging information. The fee-charging information may be a fee amount, e.g., a fee amount per page.

Figure 15:
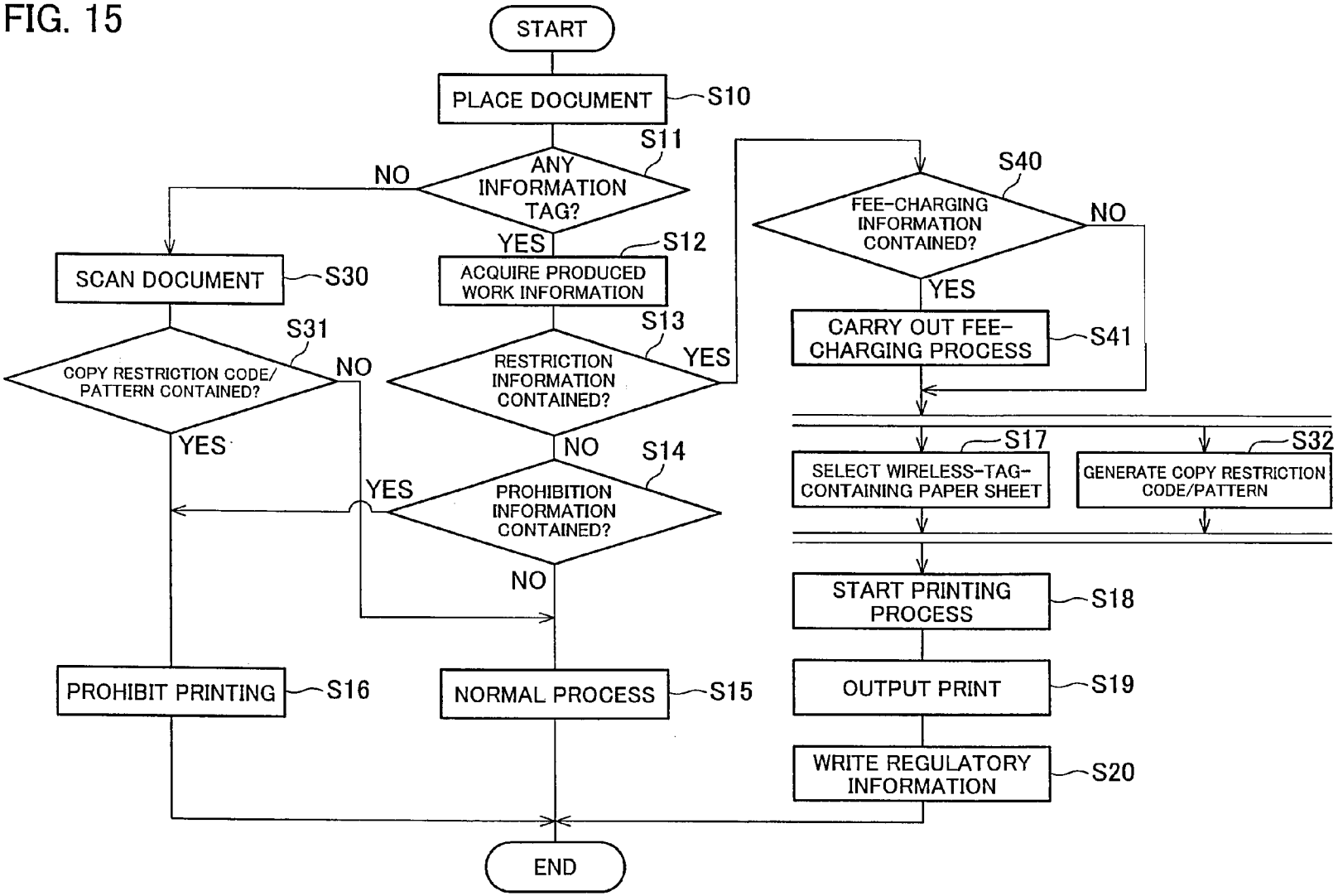
FIG. 15 is a flow chart explaining a printing process in which (i) a wireless-tag-containing recording paper sheet having a wireless tag is used, (ii) data to be used in the printing and a copy restriction code/pattern are combined when image formation is carried out, (iii) the produced work information or the like is written in the wireless tag of the wireless-tag-containing recording paper sheet, and (iv) a fee-charging process is further carried out.

FIG. 15 is a flow chart explaining a printing process in which (i) a wireless-tag-containing recording paper sheet having a wireless tag is used, (ii) data to be used in the printing and a copy restriction code/pattern are combined when image formation is carried out, (iii) the produced work information or the like is written in the wireless tag of the wireless-tag-containing recording paper sheet, and (iv) a fee-charging process is further carried out. In the following, for convenience of explanation, components and steps identical to those shown in Examples 1 to 4 are given the same numbers, and will not be explained.

In Steps S10 through S12, in cases where the document 101 placed on the document table 21 has the information tag 102, the produced work information stored in the information tag 102 is caused to be stored in the wireless tag data storage section 82. Then, the printing permission/prohibition judging section 81 judges whether or not the restriction information is contained in the produced work information stored in the wireless tag data storage section 82 (S13).

When the printing permission/prohibition judging section 81 has judged in Step S13 that the restriction information is contained (YES in S13), the printing permission/prohibition judging section 81 judges whether or not the data stored in the wireless tag data storage section 82 contains the fee-charging information (S40).

When the printing permission/prohibition judging section 81 judges in Step S40 that the fee-charging information is contained (YES in S40), the printing permission/prohibition judging section 81 commands the fee-charging processing section 93 to carry out the fee-charging process. The fee-charging processing section 93 acquires the fee-charging information from the data stored in the wireless tag data storage section 82. Then, the fee-charging processing section 93 determines the fee amount in accordance with the fee-charging information, and carries out the fee-charging process (S41). Then, the process proceeds to Steps S17 and S32.

On the other hand, when the printing permission/prohibition judging section 81 judges in Step S40 that the fee-charging information is not contained (NO in S40), the process proceeds to Steps S17 and S32.

Example 7

The following explains further another example. An MFP 1 according to Example 7 is arranged such that data stored in the information tag 102 provided in the document 101 is updated at the same time as the image forming process is carried out. Generally, the number of copies to be made from a produced work is limited to 1. However, for example, in cases where the produced work is made for mainly a distribution purpose such as a pamphlet and a guide, the number of the first-generation copies allowed to be made therefrom is set in advance in accordance with the author's wish so as to be increased, with the result that a plurality of copies, but not more than the allowed number, can be made from the original. Further, for example, later-generation copying can be restricted or prohibited by restricting or prohibiting copying using a first generation copy as a master copy. This makes it possible to prevent generation copying from being carried out for unspecified purposes by an unspecified number of people.

Figure 16:
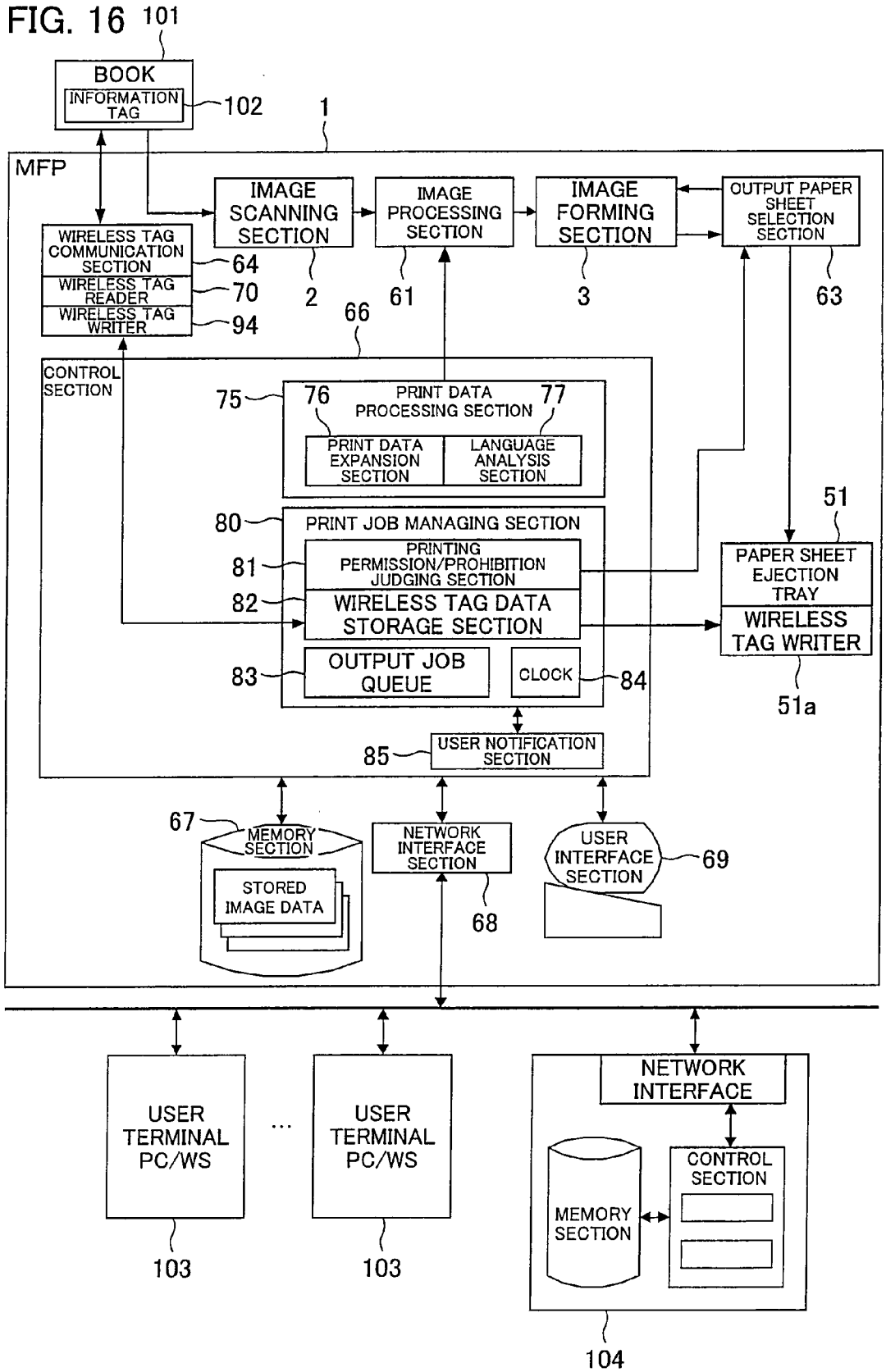
FIG. 16 is a block diagram schematically showing an arrangement of an MFP according to Example 7.

FIG. 16 is a block diagram schematically showing the arrangement of the MFP 1 according to Example 7. As shown in FIG. 16, the MFP 1 includes the wireless tag communication section 64 provided with a wireless tag writer 94 and the wireless tag reader 70, the image scanning section 2, the image processing section 61, the image forming section 3, the control section 66, the memory section 67, the user interface section 69, the network interface section 68, the output paper sheet selection section 63, and the paper sheet ejection tray 51.

The wireless tag writer 94 provided in the wireless tag communication section 64 writes information in the information tag 102 provided in the document 101.

Figure 17:
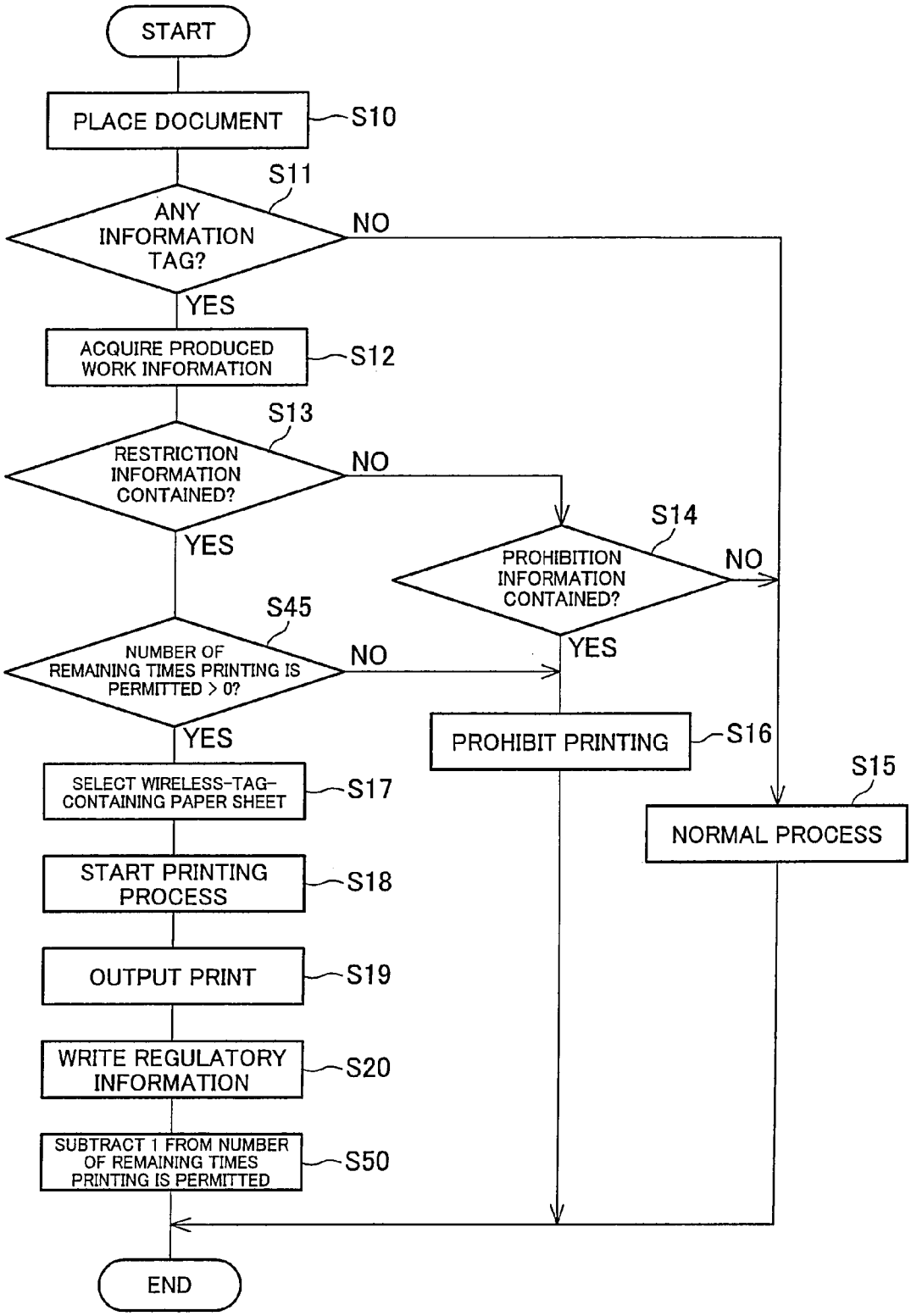
FIG. 17 is a flow chart explaining a process in which (i) a wireless-tag-containing recording paper sheet having a wireless tag is used, (ii) the produced work information or the like is written in the wireless tag of the wireless-tag-containing recording paper sheet, and (iii) information contained in the wireless tag is updated after the completion of the image formation.

FIG. 17 is a flow chart explaining a process in which (i) a wireless-tag-containing recording paper sheet having a wireless tag is used, (ii) the produced work information or the like is written in the wireless tag of the recording paper sheet, and (iii) information contained in the information tag 102 is updated after the completion of the image formation. This will be described below.

In Steps S10 through S12, in cases where the document 101 placed on the document table 21 has the information tag 102, the produced work information stored in the information tag 102 is caused to be stored in the wireless tag data storage section 82. Then, the printing permission/prohibition judging section 81 judges whether or not the restriction information is contained in the produced work information stored in the wireless tag data storage section 82 (S13). On this occasion, in Step S12, the wireless tag reader 70 reads out the number of remaining times printing is permitted (i.e., the information indicating how many more times copying is permitted) from the information tag 102, and stores the information in the wireless tag data storage section 82.

When the printing permission/prohibition judging section 81 has judged in Step S13 that the restriction information is contained (YES in S13), the printing permission/prohibition judging section 81 judges whether or not copying is permitted, in accordance with the number of remaining times the printing is permitted (S45). The number is stored in the wireless tag data storage section 82.

Then, when the printing permission/prohibition judging section 81 has judged in Step S45 that the copying is permitted, i.e., that the number of remaining times the printing is permitted is yet to be 0 (YES in S45), the printing permission/prohibition judging section 81 instructs the output paper sheet selection section 63 to select, as a paper sheet to be subjected to the image formation, a wireless-tag-containing recording paper sheet having the wireless tag. Then, the output paper sheet selection section 63 selects the wireless-tag-containing recording paper sheet in accordance with the instruction given from the printing permission/prohibition judging section 81 (S17).

Thereafter, the printing process is started (S18). The wireless-tag-containing recording paper sheet selected by the output paper sheet selection section 63 is transported to the image forming section 3. Then, the image forming section 3 forms an image (S19). After Step S19, the wireless-tag-containing recording paper sheet subjected to the image formation is ejected onto the paper sheet ejection tray 51. Then, the printing permission/prohibition judging section 81 transmits, to the wireless tag writer 51*a* installed on the paper sheet ejection tray 51, the produced work information including (i) the publication information and (ii) the generation copy information. The wireless tag writer 51*a* receives and writes the produced work information as regulatory information in the wireless tag of the wireless-tag-containing recording paper sheet ejected onto the paper sheet ejection tray 51 (S20).

When the image forming process is finished, the printing permission/prohibition judging section 81 operates the wireless tag writer 94 of the wireless tag communication section 64 such that the wireless tag writer 94 writes, in the information tag 102, the number obtained by subtracting one from the number of remaining times, with the result that the number of remaining times stored in the information tag 102 is updated (S50).

On the other hand, when the printing permission/prohibition judging section 81 judges in Step S45 that the copying is prohibited, i.e., that the number of remaining times is 0 (NO in S45), the process proceeds to Step S16.

The foregoing process makes it possible to carry out first-generation copying up to the number of remaining times set in accordance with the author's wish.

Example 8

The following explains further another example. An MFP according to Example 8 is arranged as follows. That is, in cases where the restriction information is contained in the information tag 102, an image is normally formed on a wireless-tag-containing recording paper sheet. However, in cases where the wireless-tag-containing recording paper sheet is not available, a copy restriction code/pattern is provided together with the image.

According to the foregoing arrangement, the output paper sheet selection section 63 includes a wireless tag reader 95. Therefore, in cases where the paper sheet feeding tray contains no recording paper sheet allowing for the copy restriction, or in cases where the paper sheet feeding tray cannot be selected, the print data and the copy restriction code/pattern are combined and outputted. On the other hand, in cases where the paper sheet feeding tray can be selected, the wireless-tag-containing recording paper sheet is used. With this, the printing can be restricted regardless of what type of paper sheet is contained in the paper sheet feeding tray of the MFP 1. This makes it possible to prevent propagation of the generation copying.

Figure 18:
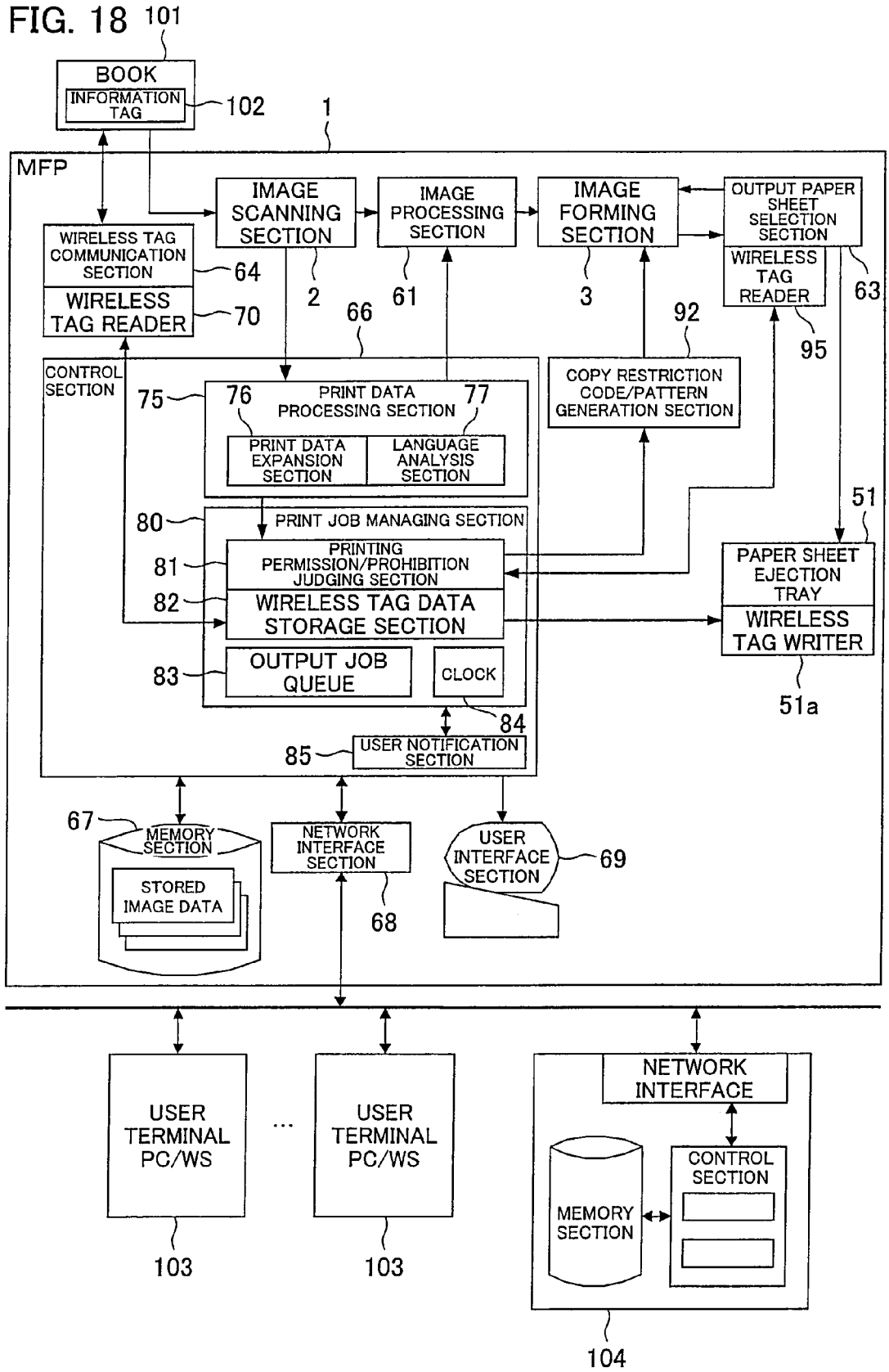
FIG. 18 is a block diagram schematically showing an MFP according to Example 8.

FIG. 18 is a block diagram schematically showing the arrangement of the MFP 1 according to Example 8. As shown in FIG. 18, the MFP according to Example 8 is arranged such that the output paper sheet selection section 63 includes the wireless tag reader 95.

Figure 19:
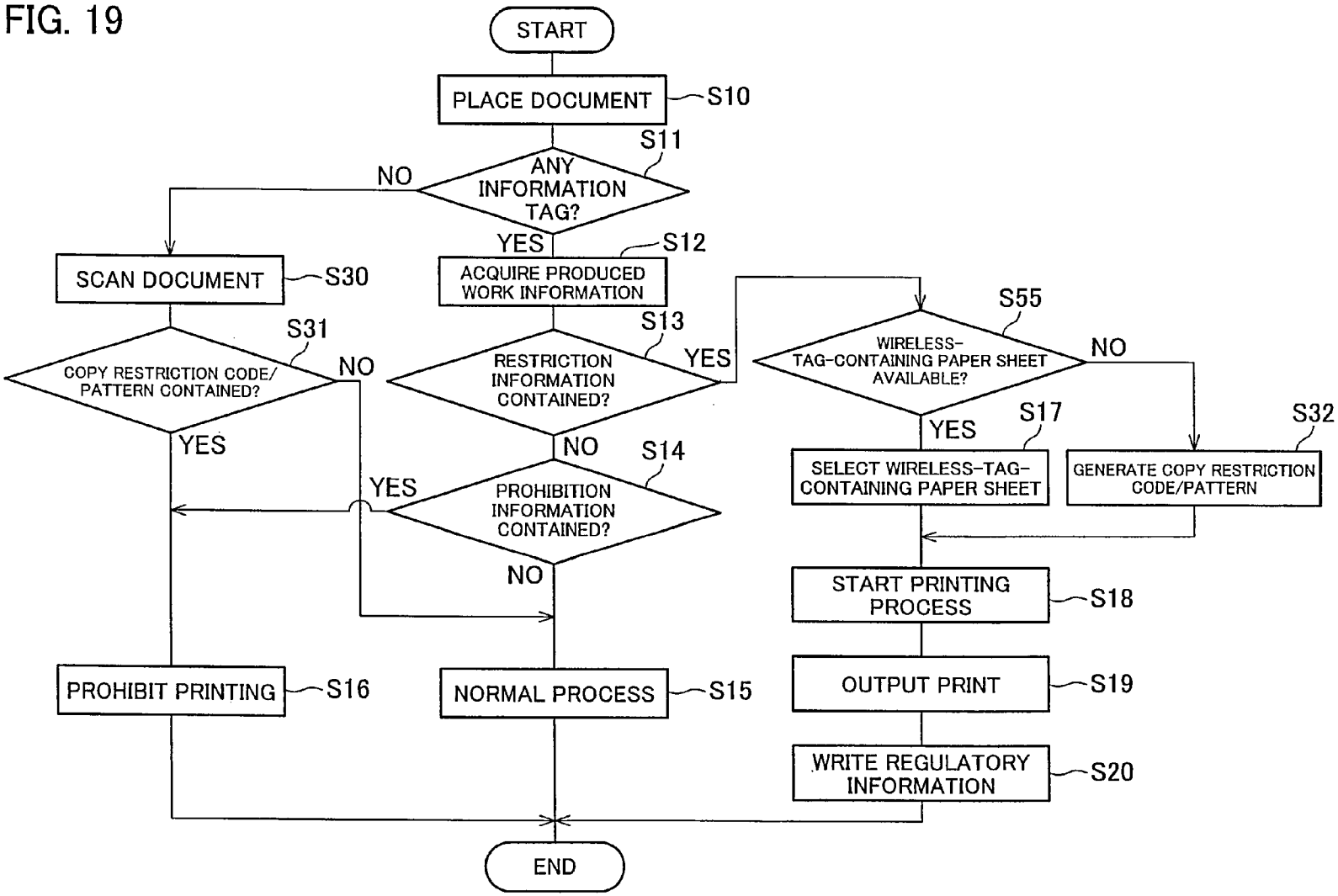
FIG. 19 is a flow chart explaining a process to be carried out in cases where an output paper sheet selection section includes a wireless tag reader.

FIG. 19 is a flow chart explaining a printing process to be carried out in cases where the output paper sheet selection section 63 includes the wireless tag reader 95.

In Steps S10 through S12, in cases where the document 101 placed on the document table 21 has the information tag 102, the produced work information stored in the information tag 102 is caused to be stored in the wireless tag data storage section 82. Then, the printing permission/prohibition judging section 81 judges whether or not the restriction information is contained in the produced work information stored in the wireless tag data storage section 82 (S13).

When the printing permission/prohibition judging section 81 judges in Step S13 that the restriction information is contained (YES in S13), the printing permission/prohibition judging section 81 operates the wireless tag reader 95 of the output paper sheet selection section 63 so as to judge whether or not the wireless-tag-containing recording paper sheet can be selected (S55). Specifically, the printing permission/prohibition judging section 81 judges, in accordance with a result of detection carried out by the wireless tag reader 95, whether or not the paper sheet feeding tray contains the wireless-tag-containing recording paper sheet. Then, in cases where the paper sheet feeding tray contains the wireless-tag-containing recording paper sheet, the printing permission/prohibition judging section 81 judges that the wireless-tag-containing recording paper sheet can be selected. In cases where the paper sheet feeding tray does not contain the wireless-tag-containing recording paper sheet, the printing permission/prohibition judging section 81 judges that the wireless-tag-containing paper sheet cannot be selected.

When the printing permission/prohibition judging section 81 judges in Step S55 that the wireless-tag-containing recording paper sheet can be selected (YES in S55), the printing permission/prohibition judging section 81 instructs the output paper sheet selection section 63 to select the wireless-tag-containing recording paper sheet. Then, the output paper sheet selection section 63 selects the wireless-tag-containing recording paper sheet as a paper sheet to be subjected to the image formation (S17). On the other hand, when the printing permission/prohibition judging section 81 judges in Step S55 that the wireless-tag-containing recording paper sheet cannot be selected (NO in S55), the printing permission/prohibition judging section 81 commands the copy restriction code/pattern generation section 92 to generate a copy restriction code/pattern (S32).

Thereafter, the printing process is started (S18). In cases where the wireless-tag-containing recording paper sheet having the wireless tag has been selected as the paper sheet to be subjected to the image formation, the printing process (image formation) is carried out (S19). Thereafter, the produced work information is caused to be stored in the wireless tag of the wireless-tag-containing recording paper sheet (S20). On the other hand, in cases where a paper sheet having no wireless tag has been selected as the paper sheet to be subjected to the image formation, (i) the copy restriction code/pattern and (ii) the image data processed by the image processing section 61 are combined in Step S19, and an image obtained through the combining is formed.

In Example 8, the print data and the copy restriction code/pattern are combined in the image forming section 3. However, for the purpose of completely prohibiting generation copying, the print data may be combined with a copy prohibition code/pattern instead of the copy restriction code/pattern. Further, the above description explains the arrangement in which the wireless tag reader 95 is provided in the output paper sheet selection section 63. However, the wireless tag reader 95 may be provided in any place inside the MFP 1 as long as the wireless tag reader 95 can recognize the wireless-tag-containing recording paper sheet. For example, the wireless tag reader 95 may be provided in any place inside the MFP 1, e.g., in the paper sheet feeding tray, the paper sheet transportation path, or the like.

Further, in the foregoing explanation, the publication information or the like is stored in the wireless tag of the wireless-tag-containing recording paper sheet. However, in case of using the wireless-tag-containing recording paper sheet having the wireless tag in which the copy restriction or prohibition information has been written in advance, the paper sheet ejection tray 51 may not include the wireless tag writer 51*a*. Furthermore, the MFP 1 may be arranged such that the wireless tag reader 95 provided in the output paper sheet selection section 63 or the like judges whether or not the paper sheet to be fed is the wireless-tag-containing recording paper sheet having the wireless tag in which the restriction information or prohibition information has been written in advance.

As described above, in the MFP 1 according to the present embodiment, the information tag 102 is embedded in advance in the document 101, and the produced work information is written in the information tag 102. When the user attempts to make a copy of the document 101 by using the MFP 1, the MFP 1 acquires the produced work information stored in the information tag 102 of the document 101. When the MFP 1 recognizes that the document 101 is copyrighted, the MFP 1 carries out the following process (A) and/or process (B): (A) the MFP 1 selects, from a paper sheet feeding tray, a recording paper sheet capable of restricting or prohibiting the generation copying, and carries out printing; and (B) the MFP 1 records the copy restriction or prohibition information onto the recording medium, or combines the copy restriction or prohibition information with the image to be printed, and carries out the printing. With this, in either case, information indicating that the recording medium (i.e., the printing target in this case) is a copy of the produced work is inherited (added) to the recording medium. This makes it possible to prevent the generation copying from being carried out by using the copy of the produced work as a master copy. Further, in cases where the document 101 is not a produced work, the MFP 1 carries out the normal process.

Examples of the process (A) include the following processes (1) and (2): (1) the MFP 1 uses the wireless-tag-containing recording paper sheet having the wireless tag in which the copy restriction information has been written in advance, and carries out the printing; and (2) the MFP 1 uses the recording paper sheet on which the copy restriction code/pattern has been printed in advance, and carries out the printing. Examples of the process (B) include the following processes (3) and (4): (3) the MFP 1 (i) uses the paper sheet having the wireless tag, (ii) writes the produced work information or the generation copy information in the wireless tag, and (iii) carries out the printing; and (4) the MFP 1 embeds (combines) the copy restriction code/pattern into (with) the image to be outputted, and carries out the printing. Further, there may be a process (5), which is a combination of the processes (1) to (4).

This makes it possible to take measures for automatically restricting generation copying. With this, in cases where the copying is carried out from the first-generation copy of the produced work, any one of the processes (1) to (5) is carried out. This makes it possible to inhibit the generation copying.

Further, when the MFP 1 recognizes the first-generation copy, the MFP 1 causes the user interface to display information indicating that the printing is permitted or prohibited, with the result that the information is notified to the user. This makes it possible to restrict or prohibit the generation copying in advance. This makes it possible to prevent propagation of the illegal copying. Further, the MFP 1 can present the copyright-related information to the user by causing the user interface to display the copyright-related information. Examples of the copyright-related information include the produced work information, the restriction information such as the number of remaining times the printing is permitted, and the generation copy information. Therefore, it is possible to ask the user for understanding of copyright.

As described above, an MFP 1 according to the present embodiment includes: an image scanning section 2 for scanning a document 101 so as to acquire image data; an image forming section 3 for forming an image on a recording paper sheet in accordance with the image data; a printing permission/prohibition judging section 81 for judging whether or not restriction information for restricting image formation is contained in either (i) a information tag 102 provided in the document 101, or (ii) the image data acquired by the image scanning section 2; and an output paper sheet selection section 63 for, when the printing permission/prohibition judging section 81 has judged that the restriction information is contained, selecting a regulatory-information-containing recording paper sheet (a recording paper sheet on which a copy restriction code/pattern has been formed in advance or a recording paper sheet having a wireless tag in which regulatory information has been stored in advance) as a recording paper sheet to which the image formation is carried out, which regulatory-information-containing sheet contains regulatory information for prohibiting or restricting image formation that is to be carried out in accordance with the recording paper sheet on which the image has been formed.

According to the foregoing arrangement, in cases where the restriction information for restricting the image formation is contained in either (i) the data stored in the information tag 102 provided in the document 101, or (ii) the image data, the regulatory-information-containing recording paper sheet which contains the regulatory information for prohibiting or restricting the image forming process (an image scanning process and a developing process) is selected. With this, the image forming section 3 carries out the image formation with respect to the regulatory-information-containing recording paper sheet. Moreover, in cases where one makes an attempt to carry out the copying process (the image forming process) in accordance with the regulatory-information-containing recording paper sheet, the copying process is prohibited or restricted due to the regulatory information.

Therefore, the recording paper sheet outputted after the image formation contains the regulatory information, so that it is possible to restrict or prohibit the image forming process to be carried out in accordance with the recording paper sheet.

With this, for example, it is possible to restrict or prohibit copying (generation copying) to be made from a copy of a produced work (a regulatory-information-containing recording paper sheet on which an image has been formed).

The information tag 102 is a medium capable of storing information, and examples of the medium include at least one of an IC tag, a flash memory, a hard disk, and the like.

The MFP 1 according to the present embodiment may be arranged such that: the output paper sheet selection section 63 selects the regulatory-information-containing recording paper sheet on which the regulatory information is recorded as an image.

According to the foregoing arrangement, since the regulatory-information-containing recording paper sheet on which the regulatory information has been recorded as an image is selected, the recording paper sheet subjected to the image formation has the regulatory information recorded as an image thereon.

This makes it possible to find that the regulatory-information-containing recording paper sheet contains the regulatory information, even in cases where, e.g., a conventional MFP 1 carries out the image formation in accordance with the regulatory-information-containing recording paper sheet. Therefore, it is possible to restrict or prohibit the image formation that is to be carried out in accordance with the regulatory-information-containing recording paper sheet.

The MFP 1 according to the present embodiment may be arranged such that: the output paper sheet selection section 63 selects the regulatory-information-containing recording paper sheet provided with the information tag 102 in which the regulatory information has been stored.

According to the foregoing arrangement, since the regulatory-information-containing recording paper sheet having the information tag 102 in which the regulatory information has been stored is selected, the regulatory information is stored in the information tag 102. Therefore, as compared with the arrangement in which the image formation is carried out with respect to the recording paper sheet on which the regulatory information has been recorded as an image, a more faithful image formation can be carried out in accordance with the image data acquired by the image scanning section 2. That is, no regulatory information is contained in the image formed by the image forming section 3.

Therefore, the foregoing arrangement makes it possible to both add the regulatory information and carry out copying faithful to the document 101.

The MFP 1 according to the present embodiment may be arranged so as to further include: a copy restriction code/pattern generation section 92 for adding, to the recording paper sheet to be subjected to the image formation, the regulatory information for prohibiting or restricting the image formation.

According to the foregoing arrangement, the regulatory information can be added to the recording paper sheet to be subjected to the image formation. With this, for example, the regulatory information can be added even in cases where the regulatory-information-containing recording paper sheet is not available and the image formation is therefore carried out with respect to a normal recording paper sheet (a recording paper sheet containing no regulatory information). Similarly, the regulatory information can be added to the regulatory-information-containing recording paper sheet from which regulatory information has been deleted. Therefore, even in cases where the regulatory-information-containing recording paper sheet is not available and where the regulatory information has been deleted from the regulatory-information-containing recording paper sheet, the regulatory information can be added to the recording paper sheet to be outputted without interrupting the image forming process.

The MFP 1 according to the present embodiment may be arranged so as to further include: a control section 66 for prohibiting the image forming process in cases where the regulatory-information-containing recording paper sheet is not selectable.

According to the foregoing arrangement, the image forming process can be prohibited in cases where the regulatory-information-containing recording paper sheet is not available and the image formation cannot be therefore carried out with respect to the regulatory-information-containing recording paper sheet.

An MFP 1 according to the present embodiment includes: an image scanning section 2 for scanning a document 101 so as to acquire image data; an image forming section 3 for forming an image on a recording paper sheet in accordance with the image data; a printing permission/prohibition judging section 81 for judging whether or not restriction information for restricting the image formation is contained in either (i) an information tag 102 provided in the document 101, or (ii) the image data acquired by the image scanning section 2; and a copy restriction code/pattern generation section 92 for, when the printing permission/prohibition judging section 81 has judged that the restriction information is contained, adding regulatory information to the recording paper sheet on which the image is to be formed, which regulatory information allows prohibition or restriction of image formation.

According to the foregoing arrangement, the regulatory information is added to the recording paper sheet, so that the copy of the document 101 contains the regulatory information and is outputted from the MFP 1. Therefore, it is possible to prevent unlimited copying using the copy.

Further, even in cases where the regulatory information has not been added in advance, the regulatory information can be added later. Therefore, the regulatory information can be added to any type of recording paper sheet.

The MFP 1 according to the present embodiment may be arranged such that: the copy restriction code/pattern generation section 92 controls the image forming section 3 such that the regulatory information is added as an image to the recording paper sheet.

According to the foregoing arrangement, the regulatory information is added as an image. That is, while the image is formed in accordance with the image data acquired by the image scanning section 2, the regulatory information is also formed as an image. With this, for example, the regulatory information can be added even in cases where the image is formed on a recording paper sheet having no information tag 102 capable of storing various types of information.

The MFP 1 according to the present embodiment may be arranged such that: the MFP 1 selects, as the recording paper sheet, a wireless-tag-containing recording paper sheet having the information tag 102 capable of storing information, and stores the regulatory information in the information tag 102.

According to the foregoing arrangement, the wireless-tag-containing recording paper sheet having the information tag 102 is selected as the recording paper sheet so as to be subjected to the image formation, and the regulatory information is stored in the information tag 102. With this, even in cases where the regulatory information has not been stored in advance in the information tag 102, the regulatory information can be added.

The MFP 1 according to the present embodiment may be arranged such that: the copy restriction code/pattern generation section 92 further adds, to the recording paper sheet, document 101 information concerning the document 101.

Examples of the document 101 information include at least one of (i) author information indicating an author of the document 101, (ii) owner information indicating an owner of the document 101, and (iii) generation copy information indicating a generation of the document 101 as counted from the original.

According to the foregoing arrangement, the document 101 information, as well as the regulatory information, is added to the recording paper sheet on which the image is to be formed. With this, the document 101 information can be recorded onto the recording paper sheet on which the image is to be formed. Therefore, for example, it is possible to find out the author and the like of the image formed on the recording paper sheet.

The MFP 1 according to the present embodiment may be arranged such that: the document 101 has the information tag 102 storing the document 101 information concerning the document 101 which document 101 information includes the restriction information, the MFP 1, further including: a wireless tag reader for reading out the document 101 information from the information tag 102 provided in the document 101, wherein: the copy restriction code/pattern generation section 92 adds, to the recording paper sheet, the document 101 information acquired by the wireless tag reader.

According to the foregoing arrangement, the document 101 information stored in the information tag 102 provided in the document 101 is added to the recording paper sheet on which the image is to be formed. This makes it possible to make a copy having the same information as the document 101 does.

The MFP 1 according to the present embodiment may be arranged so as to further include: a user interface section 69 for displaying the restriction information.

According to the foregoing arrangement, the user interface section 69 for displaying the restriction information is provided. With this, the user operating the MFP 1 can check the restriction information displayed by the user interface section 69. This allows the user to know whether or not the restriction information is contained in the document 101.

The MFP 1 according to the present embodiment may be arranged such that: the document 101 has the information tag 102 storing the document 101 information concerning the document 101 which document 101 information includes the restriction information; and the user interface section 69 displays the document 101 information.

According to the foregoing arrangement, the document 101 information is displayed. This allows the user to check the document 101 information stored in the information tag 102 provided in the document 101.

The MFP 1 according to the present embodiment may be arranged so as to further includes: a fee-charging processing section 93; and the printing permission/prohibition section 81, wherein: the information tag 102 stores fee-charging information for charging a fee for the image forming process that is to be carried out in accordance with the document 101; and the fee-charging processing section 93 determines a fee amount in accordance with the fee-charging information, and carries out a fee-charging process in accordance with the fee amount; and the printing permission/prohibition judging section 81 judges whether or not the fee-charging process has been carried out normally, and permits the image forming process when the fee-charging process has been carried out normally.

According to the foregoing arrangement, the image forming process is permitted when the fee-charging process is finished. The fee-charging process is carried out in accordance with the fee amount determined in accordance with the fee-charging information acquired from the information tag 102 provided in the document 101.

With this, an appropriate fee-charging process can be carried out in the case of using, e.g., the MFP 1 installed in a convenience store or the like for business purposes.

Further, since the fee amount is determined in accordance with the fee-charging information acquired from the information tag 102, a fee-charging process corresponding to the document 101 can be carried out.

Examples of the fee-charging processing section 93 include (i) a cash-counting machine and (ii) a program for calculating a fee amount by measuring an information amount.

The MFP 1 according to the present embodiment may be arranged so as to further include: a wireless tag writer 94 for updating information stored in the information tag 102 provided in the document 101.

According to the foregoing arrangement, it is possible to update the information stored in the information tag 102 provided in the document 101. With this, for example, the information stored in the information tag 102 can be updated in cases where the restriction information changes with the passage of time. A specific example of such restriction information is restriction information by which the image formation is restricted within a certain period of time but becomes unrestricted after passage of a certain time.

Further, consider the following example. That is, although the user does not set a wireless-tag-containing recording paper sheet in the paper sheet feeding cassette in fact, he/she does such a setting of the MFP 1 that he/she set the wireless-tag-containing recording paper sheet in the paper sheet feeding cassette. In such a case, the image formation is possibly carried out without adding the regulatory information. Such a situation can be handled as follows. For example, in cases where the MFP 1 is used for business purposes in, e.g., a convenience store or the like, the MFP 1 may be set such that only a clerk of the convenience store or an administrator of the MFP 1 can change the setting for the recording paper sheet contained in the paper sheet feeding cassette. Alternatively, the paper sheet feeding cassette may be locked such that only the administrator can remove the paper sheet feeding cassette.

Further, in order to check for the improper operations on the paper sheet feeding cassette, an RFID reader (wireless tag reader) may be provided, for example, in the transportation path so as to check a paper sheet being fed.

Further, instead of the wireless-tag-containing recording paper sheet, the regulatory information may be added, for example, to a paper sheet in the form of an IR-readable pattern. In this case, the paper sheet feeding cassette is provided with a sensor. This makes it possible to judge whether or not the paper sheet containing the IR-readable pattern is contained in the paper sheet feeding cassette. Further, the manual feeding tray may be provided with a reader or sensor such that paper sheets are checked one by one before being fed.

Further, in the foregoing explanation, the judgment about whether or not the restriction information is contained in the image data is carried out in cases where the restriction information is not contained in the information tag 102. However, the present invention is not limited to this, and (i) the judgment about whether or not the restriction information is contained in the information tag 102 and (ii) the judgment about whether or not the restriction information is contained in the image data may be carried out in any order. For example, the judgment whether or not the restriction information is contained in the information tag 102 may be carried out after it is judged, in the judgment whether or not the restriction information is contained in the image data, that the restriction information is not contained in the image data. Alternatively, these judgments may be carried out simultaneously.

Further, an MFP 1 according to the present embodiment may be arranged so as to include: an image scanning section 2 for acquiring image data from a document 101; an image forming section 3 for forming an image on a recording medium in accordance with the image data thus acquired; a produced work information communication section (wireless tag reader) for communicating with a produced work information storage medium (wireless tag) which is provided in a produced work and which prestores produced work information concerning the produced work; and a judging section (printing permission/prohibition judging section 81) for judging, in accordance with the produced work information acquired from the produced work information storage medium by the produced work information communication section, whether or not the document 101 is the produced work, the MFP 1 judging whether or not copying to be carried out is copying of the produced work, the MFP 1 selecting, when carrying out image formation in accordance with the image data acquired from the document 101 judged to be the produced work, a recording paper sheet capable of restricting or prohibiting generation copying, the MFP 1 carrying out printing. With this, in cases where it has been judged that copying of a produced work such as a book is carried out, a recording paper sheet capable of restricting or prohibiting generation copying is compulsorily selected. This makes it possible to prevent propagation of the generation copying using a copy of the produced work as a master copy.

Further, an MFP 1 according to the present embodiment may be arranged so as to include: an image scanning section 2 for acquiring image data from a document 101; an image forming section 3 for forming an image on a recording medium in accordance with the image data thus acquired; a produced work information communication section (wireless tag reader) for communicating with a produced work information storage medium (wireless tag) which is provided in a produced work and which prestores produced work information concerning the produced work; and a judging section for judging, in accordance with the produced work information acquired from the produced work information storage medium by the produced work information communication section, whether or not the document 101 is the produced work, the MFP 1 judging whether or not copying to be carried out is copying of the produced work, the MFP 1 recording copy restriction or prohibition information onto the recording medium to be subjected to image formation that is to be carried out in accordance with the image data acquired from the document 101 judged to be the produced work, or combining the copy restriction or prohibition information with an image to be printed, the MFP 1 carrying out printing. With the foregoing arrangement, in cases where it has been judged that copying of a produced work such as a book is carried out, the information for restricting or prohibiting generation copying is recorded in or combined with a recording medium. This makes it possible to prevent propagation of the generation copying using a copy of the produced work as a master copy.

Further, the MFP 1 according to the present embodiment may be arranged such that: in cases where copying of a produced work is carried out, a wireless-tag-containing recording paper sheet is compulsorily selected. With this, the wireless-tag-containing recording paper sheet is compulsorily selected. Accordingly, it becomes possible to automatically restrict or prohibit generation copying. This makes it possible to propagation of the illegal copying.

Further, the MFP according to the present embodiment may be arranged such that: in cases where copying of a produced work is carried out, a recording paper sheet on which a copy restriction code/pattern has been printed in advance is compulsorily selected. With this, the recording paper sheet on which the copy restriction code/pattern has been printed in advance is compulsorily selected. Accordingly, it becomes possible to automatically restrict generation copying. This makes it possible to propagation of the illegal copying.

Further, the MFP 1 according to the present embodiment may be arranged such that: in cases where copying of a produced work is carried out, the copy restriction or prohibition information, the produced work information, or the generation copy information is written in a wireless tag of a wireless-tag-containing recording paper sheet. With this, the produced work information or the generation copy information is written in the wireless tag of the wireless-tag-containing recording paper sheet. This makes it possible to prevent propagation of the generation copying using a copy of the produced work as a master copy.

Further, the MFP 1 according to the present embodiment may be arranged such that: in cases where copying of a produced work is carried out, the copy restriction code/pattern is embedded in (combined with) an image to be outputted. This allows a copying machine to recognize the copy restriction code/pattern. This makes it possible to prevent propagation of the generation copying using a copy of the produced work as a master copy.

Further, the MFP 1 according to the present embodiment may be arranged such that: in cases where copying of a produced work is carried out, owner information of the produced work is inherited to a recording medium together with the produced work information and the generation copy information. This makes it possible to track down an owner of the produced work by using a first-generation copy.

Further, the MFP 1 according to the present embodiment may be arranged such that: a user interface displays, in accordance with a result of judging whether or not copying to be carried out is copying of a produced work, information indicating whether printing (copying) is permitted or prohibited, so as to notify the information to the user. This allows the user to easily check, with his/her eyes, whether the printing/copying is permitted.

Further, the MFP 1 according to the present embodiment may be arranged such that: the user interface displays, in accordance with a result of judging whether or not copying to be carried out is copying of a produced work, copyright-related information such as (i) the produced work information, (ii) the restriction information such as the number of remaining times the printing is permitted, or (iii) the generation copy information. This allows the user to easily check, with his/her eyes, the produced work information, the number of remaining times the printing is permitted, the generation copy information, or the like. This also makes it possible to ask the user for understanding of copyright.

Further, the MFP 1 may be arranged such that: a fee amount is determined in accordance with information stored in a wireless tag; and copying is permitted based on a fee-charging system. With this, for example, the user can make a copy of only desired information from a sample book provided at a convenience store or the like, and is charged a fee for the printing by an appropriate fee-charging process.

Further, the MFP 1 according to the present embodiment may be arranged such that: the number of times first-generation copying is permitted can be changed in accordance with the information stored in the wireless tag. With this, especially in cases where the produced work is made for mainly a distribution purpose such as a pamphlet and a guide, the number of the first-generation copies allowed to be made therefrom is set in advance in accordance with the author's wish so as to be increased, with the result that a plurality of copies, but not more than the allowed number, can be made from the original. Further, later-generation copying can be restricted or prohibited, so that it is possible to prevent generation copying from being carried out for unspecified purposes by an unspecified number of people.

Further, the MFP 1 according to the present embodiment may be arranged such that: in cases where a recording paper sheet capable of restricting or prohibiting generation copying is not contained in the paper sheet feeding tray or cannot be selected when copying of a produced work is carried out, the MFP 1 records copy restriction or prohibition information onto a recording medium to be subjected to image formation, or combines the copy restriction or prohibition information with an image to be formed, and then carries out printing. With this, even in cases where the recording paper sheet capable of restricting or prohibiting generation copying is not contained in the paper sheet feeding tray when the copying of the produced work is carried out, the MFP 1 records/combines the copy restriction or prohibition information onto/with the recording medium to be subjected to the image formation. This makes it possible to prevent propagation of the generation copying.

The present invention is not limited to the description of the embodiments above, but may be altered by a skilled person within the scope of the claims. An embodiment based on a proper combination of technical means disclosed in different embodiments is encompassed in the technical scope of the present invention.

Finally, each of the blocks of the MFP 1, especially the control section 66, may be constituted by hardware logic, or by software with the use of a CPU as follows.

That is, the MFP 1 has: (i) the CPU (central processing unit) for executing an instruction of control program realizing various functions; (ii) a ROM (read only memory) storing the program; (iii) a RAM (random access memory) for expanding the program; (iv) a storage device (storage medium) such as a memory storing the program and various data; and (v) the like. The object of the present invention also can be achieved by (i) providing, for the MFP 1, a storage medium storing, in a computer readable manner, a program code (executable program; intermediate code; source program) of the control program for the present system, and (ii) causing a computer (CPU or MPU) to read and execute the program code stored in the storage medium, the program code being the software realizing the aforementioned functions.

Examples of the storage medium are: (i) tapes such as a magnetic tape and a cassette tape; (ii) magnetic disks such as a Floppy® disk and a hard disk; (iii) optical disks such as a compact disk read only memory (CD-ROM), a magnetic optical disk (MO), a mini disk (MD), a digital video disk (DVD), and a CD-Rewritable (CD-R); (iv) cards such as an IC card (inclusive of a memory card) and an optical card; and (v) semiconductor memories such as a mask ROM, an EPROM (electrically programmable read only memory), an EEPROM (electrically erasable programmable read only memory), and a flash ROM.

Further, the MFP 1 may be connectable to the communication network, and the program code may be supplied via the communication network. The communication network is not particularly limited. Specific examples thereof are: the Internet, Intranet, Extranet, LAN (local area network), ISDN (integrated services digital network), VAN (value added network), CATV (cable TV) communication network, virtual private network, telephone network, mobile communication network, satellite communication network, and the like. Further, the transmission medium constituting the communication network is not particularly limited. Specific examples thereof are: (i) a wired channel using an IEEE 1394, a USB (universal serial bus), a power-line communication, a cable TV line, a telephone line, an ADSL line, or the like; or (ii) a wireless communication using IrDA, infrared rays used for a remote controller, Bluetooth®, IEEE 802.11, HDR (High Data Rate), a mobile phone network, a satellite connection, a terrestrial digital network, or the like. Note that, the present invention can be realized by (i) a carrier wave realized by electronic transmission of the program code, or (ii) a form of a series of data signals.

An image forming apparatus according to the present invention includes: image scanning means for scanning a document so as to acquire image data; image forming means for forming an image on a sheet in accordance with the image data; information judging means for judging whether or not restriction information for restricting image formation is contained in either (i) a storage device provided in the document, or (ii) the image data acquired by the image scanning means; and sheet selection means for, when the information judging means has judged that the restriction information is contained, selecting a regulatory-information-containing sheet as a sheet to which the image forming means carries out the image formation, which regulatory-information-containing sheet contains regulatory information for prohibiting or restricting image formation that is to be carried out in accordance with the sheet on which the image has been formed.

With this, for example, it is possible to restrict or prohibit copying (generation copying) using a copy (a regulatory-information-containing sheet on which an image has been formed) of a produced work as a master copy.

The image forming apparatus according to the present invention may be arranged such that: the sheet selection means selects the regulatory-information-containing sheet on which the regulatory information is recorded in advance as an image.

According to the foregoing arrangement, since the regulatory-information-containing sheet on which the regulatory information has been recorded in advance as an image (a regulatory image) is selected so as to be subjected to the image formation, the sheet subjected to the image formation has the regulatory information recorded as an image thereon.

With this, for example, even an image forming apparatus incapable of recording the regulatory information later can output a sheet to which the regulatory information has been added.

The image forming apparatus according to the present invention may be arranged such that: the sheet selection means selects the regulatory-information-containing sheet provided with a storage device in which the regulatory information has been stored in advance.

According to the foregoing arrangement, since the regulatory-information-containing recording paper sheet having the storage device in which the regulatory information has been stored in advance is selected, there is no need to store the regulatory information later. Further, as compared with the arrangement in which the regulatory information is formed as an image, the arrangement in which the regulatory information is stored in the storage device allows formation of an image more faithful to the document. That is, no regulatory information is contained in the image formed by the image forming means. Therefore, with the foregoing arrangement, the regulatory information is added, and the image formation faithful to the document can be carried out.

The image forming apparatus according to the present invention may be arranged so as to further include: regulatory information adding means for adding, to the sheet on which the image is to be formed, the regulatory information for prohibiting or restricting the image formation.

According to the foregoing arrangement, the regulatory information can be added to the sheet on which the image is to be formed. With this, for example, the regulatory information can be added even in cases where the regulatory-information-containing recording paper sheet is not available and the image formation is therefore carried out with respect to a normal recording paper sheet (a recording paper sheet containing no regulatory information). Similarly, the regulatory information can be added to the regulatory-information-containing recording paper sheet from which regulatory information has been deleted. Therefore, even in cases where the regulatory-information-containing recording paper sheet is not available and where the regulatory information has been deleted from the regulatory-information-containing recording paper sheet, the regulatory information can be added to the sheet to be outputted without interrupting the image forming process.

The image forming apparatus according to the present invention may be arranged so as to further include: process prohibition means for, when the regulatory-information-containing sheet is not selectable, prohibiting the image formation from being carried out by the image forming means.

According to the foregoing arrangement, the image forming process can be prohibited in cases where the regulatory-information-containing sheet is not available and the image formation cannot be therefore carried out with respect to the regulatory-information-containing sheet.

An image forming apparatus according to the present invention includes: image scanning means for scanning a document so as to acquire image data; image forming means for forming an image on a sheet in accordance with the image data; information judging means for judging whether or not restriction information for restricting the image formation is contained in either (i) a storage device provided in the document, or (ii) the image data acquired by the image scanning means; and regulatory information adding means for, when the information judging means has judged that the restriction information is contained, adding regulatory information to the sheet on which the image is to be formed, which regulatory information allows prohibition or restriction of image formation.

With this, the copy of the document contains the regulatory information, and is outputted from the image forming apparatus. Therefore, it is possible to prevent unlimited copying using the copy.

The image forming apparatus according to the present invention may be arranged such that: the regulatory information adding means controls the image forming means such that the regulatory information is added as an image to the sheet.

According to the foregoing arrangement, the regulatory information is added as an image (regulatory image). That is, while the image is formed in accordance with the image data acquired by the image scanning means, the regulatory information is also formed as an image. With this, for example, the regulatory information can be added even in cases where the image is formed on a recording paper sheet having no storage device capable of storing various types of information.

The image forming apparatus according to the present invention may be arranged so as to further include: sheet selection means for selecting a sheet to be subjected to the image formation, wherein: when the information judging means has judged that the restriction information is contained, the sheet selection means selects, as the sheet to be subjected to the image formation, a storage-device-containing sheet having a storage device capable of storing information; and the regulatory information adding means stores the regulatory information in the storage device.

According to the foregoing arrangement, the storage-device-containing sheet having the storage device is selected as the sheet so as to be subjected to the image formation, and the regulatory information is stored in the storage device. With this, even in cases where the regulatory information has not been stored in advance in the storage device, the regulatory information can be added.

The image forming apparatus according to the present invention may be arranged such that: the regulatory information adding means controls the image forming means such that document information concerning the document is formed as an image on the sheet.

Examples of the document information include at least one of (i) author information indicating an author of the document, (ii) owner information indicating an owner of the document, and (iii) generation copy information (a) indicating a generation of the document as counted from the original.

According to the foregoing arrangement, the document information as well as the regulatory information is added (formed) as an image to (on) the sheet on which the image is to be formed. With this, the document information can be added, as an image, to the sheet on which the image is to be formed. Therefore, for example, it is possible to find out the author and the like of the image formed on the sheet.

The document information may be acquired, for example, by the user's inputting the document information. In cases where the document information is stored in the storage device, the document information may be acquired from the storage device.

The image forming apparatus according to the present invention may be arranged so as to further include: document information acquisition means, wherein: the storage device stores the document information; and the document information acquisition means acquires the document information from the storage device; and the regulatory information adding means adds the document information to the sheet.

According to the foregoing arrangement, the document information stored in the storage device provided in the document is added to the sheet on which the image is to be formed. This makes it possible to make a copy having the same information as the document does.

The image forming apparatus according to the present invention may be arranged so as to further include: display means for displaying the restriction information.

According to the foregoing arrangement, the display means for displaying the restriction information is provided. With this, the user operating the image forming apparatus can check the restriction information displayed by the display means. This allows the user to know whether or not the restriction information is contained in the document.

The image forming apparatus according to the present invention may be arranged such that: the storage device stores document information concerning the document; and the display means displays the document information.

According to the foregoing arrangement, the document information is displayed. This allows the user to check the document information stored in the storage device provided in the document.

The image forming apparatus according to the present invention may be arranged so as to further include: fee-charging processing means; and permission means, wherein: the storage device stores fee-charging information for charging a fee for the image formation that is to be carried out in accordance with the document; and the fee-charging processing means determines a fee amount in accordance with the fee-charging information, and carries out a fee-charging process in accordance with the fee amount; and the permission means judges whether or not the fee-charging process has been carried out normally, and permits the image formation when the fee-charging process has been carried out normally.

According to the foregoing arrangement, the image forming process is permitted when the fee-charging process is finished. The fee-charging process is carried out in accordance with the fee amount determined in accordance with the fee-charging information acquired from the storage device provided in the document has been finished.

With this, for example, an appropriate fee-charging process can be carried out in the case of using, e.g., the image forming apparatus installed in a convenience store or the like for business purposes.

Further, since the fee amount is determined in accordance with the fee-charging information acquired from the storage, a fee-charging process corresponding to the document can be carried out.

Examples of the fee-charging processing means include (i) a cash-counting machine and (ii) a program for calculating a fee amount by measuring an information amount.

The image forming apparatus according to the present invention may be arranged so as to further include: updating means for updating information stored in the storage device.

According to the foregoing arrangement, it is possible to update the information stored in the storage device provided in the document. With this, for example, the information stored in the storage device can be updated in cases where the restriction information changes with the passage of time. A specific example of such restriction information is restriction information by which the image formation is restricted within a certain period of time but becomes unrestricted after passage of certain time.

An image forming apparatus according to the present invention can be suitably applied particularly to an image forming apparatus, such as a copying machine or a digital complex machine, which carries out copying of a produced work or the like.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus, comprising:

image scanning means for scanning a document so as to acquire image data that represents an image on the document;

image forming means for copying, in accordance with the image data, the image onto a sheet carried to the image forming means;

information judging means for judging whether or not restriction information for restricting how many generations of the copying is allowed to be made from the document is contained in either (i) a storage device provided in the document, or (ii) the image data acquired by the image scanning means;

a cassette for containing a regulatory-information-containing sheet containing regulatory information;

a normal cassette for containing a normal sheet containing no regulatory information; and sheet selection means (a) for, when the information judging means has judged that the restriction information is contained, selecting the cassette for containing the regulatory-information-containing sheet so as to carry the sheet contained in the cassette to the image forming means and (b) for, when the information judging means has judged that no restriction information is contained, selecting the normal cassette for containing the normal sheet so as to carry the sheet contained in the normal cassette to the image forming means, the regulatory information serving as information for causing the image forming apparatus or another image forming apparatus to recognize that the image formed on the regulatory-information-containing sheet is prohibited or restricted from being copied onto another sheet.

2. The image forming apparatus as set forth in claim 1, wherein:

the regulatory-information-containing sheet is a sheet on which the regulatory information is recorded in advance as an image.

3. The image forming apparatus as set forth in claim 1, wherein the regulatory-information-containing sheet is a sheet provided with a storage device in which the regulatory information has been stored in advance.

4. The image forming apparatus as set forth in claim 1, further comprising:

process prohibition means for, when the regulatory-information-containing sheet is not selectable, prohibiting the image formation from being carried out by the image forming means.

5. The image forming apparatus as set forth in claim 1, further comprising sheet judging means, wherein:

the regulatory-information-containing sheet serves as a memory-device-containing sheet having a memory device in which the regulatory information has been stored in advance;

the sheet judging means judges whether or not the cassette for containing the regulatory-information-containing sheet contains the memory-device-containing sheet;

when the information judging means has judged that the restriction information is contained and the sheet judging means has judged that the cassette for containing the regulatory-information-containing sheet contains the memory-device-containing sheet, the sheet selection means selects the cassette for containing the regulatory-information-containing sheet so as so carry the sheet contained in the cassette to the image forming means; and when the information judging means has judged that the restriction information is contained and the sheet judging means has judged that the cassette for containing the regulatory-information containing sheet contains no memory-device-containing sheet, the sheet selection means selects the normal cassette for containing the normal sheet so as to carry the sheet contained in the normal cassette to the image forming means, combines image data indicative of the regulatory information with the image data which has been acquired by the image scanning means, and causes the image forming means to carry out the image formation so that an image indicated by image data obtained through the combining is formed on the sheet carried from the normal cassette.

* * * * *